US012077895B2

(12) United States Patent
Kim et al.

(10) Patent No.: US 12,077,895 B2
(45) Date of Patent: Sep. 3, 2024

(54) LAUNDRY TREATING APPARATUS

(71) Applicant: LG ELECTRONICS INC., Seoul (KR)

(72) Inventors: Dongcheol Kim, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 37 days.

(21) Appl. No.: 17/401,745

(22) Filed: Aug. 13, 2021

(65) Prior Publication Data

US 2022/0049404 A1 Feb. 17, 2022

(30) Foreign Application Priority Data

Aug. 14, 2020 (KR) ..... 10-2020-0102615

(51) Int. Cl.
*D06F 37/40* (2006.01)
*D06F 23/04* (2006.01)
*D06F 37/24* (2006.01)

(52) U.S. Cl.
CPC ..... *D06F 37/40* (2013.01); *D06F 23/04* (2013.01); *D06F 37/24* (2013.01)

(58) Field of Classification Search
CPC ..... D06F 13/02; D06F 17/10; D06F 37/40; D06F 37/24; D06F 23/04
USPC ..... 68/133
See application file for complete search history.

(56) References Cited

U.S. PATENT DOCUMENTS 2,235,452 A * 3/1941 Kirby ..... D06F 13/00 68/54
3,987,651 A * 10/1976 Platt ..... D06F 13/00 68/133
3,987,652 A * 10/1976 Ruble ..... D06F 13/00 68/134
4,164,130 A 8/1979 Hammer
4,391,107 A * 7/1983 Gibson ..... D06F 13/02 68/133
4,718,258 A * 1/1988 Mason ..... D06F 37/40 74/21
4,858,450 A * 8/1989 Noh ..... D06F 13/02 68/134
6,497,121 B1 * 12/2002 Walsh ..... D06F 13/02 68/19.2

(Continued)

FOREIGN PATENT DOCUMENTS

KR 19980085150 12/1998
KR 200298581 12/2002

(Continued)

OTHER PUBLICATIONS

International Search Report and Written Opinion in International Appln. No. PCT/US2009/042061, dated Nov. 10, 2021, 9 pages.

*Primary Examiner* — David G Cormier
*Assistant Examiner* — Thomas Bucci
(74) *Attorney, Agent, or Firm* — Fish & Richardson P.C.

(57) ABSTRACT

A laundry treating apparatus includes a tub, a drum, and a rotator, the rotator includes a bottom portion positioned on a bottom surface, a pillar protruding from the bottom portion toward an open surface, and a blade disposed on an outer circumferential surface of the pillar, wherein one end of the blade faces toward the bottom portion, and the other end of the blade faces toward the open surface, and the blade includes a plurality of divided blades separated and spaced apart from each other between said one end and the other end.

20 Claims, 14 Drawing Sheets

(56) References Cited

U.S. PATENT DOCUMENTS

| | | | | |
|---|---|---|---|---|
| 2004/0016267 | A1* | 1/2004 | Clark | D06F 13/02 68/133 |
| 2012/0118023 | A1* | 5/2012 | Guerrero Lara | D06F 37/308 68/12.19 |
| 2017/0260673 | A1* | 9/2017 | Obregon | D06F 17/10 |

FOREIGN PATENT DOCUMENTS

| | | | | |
|---|---|---|---|---|
| WO | WO9313257 | | 7/1993 | |
| WO | WO-9313257 | A1 * | 7/1993 | D06F 13/02 |

* cited by examiner

LAUNDRY TREATING APPARATUS

CROSS-REFERENCE TO RELATED APPLICATIONS

This application claims the benefit of Korean Patent Application No. 10-2020-0102615, filed on Aug. 14, 2020, which is hereby incorporated by reference as if fully set forth herein.

BACKGROUND

Field

The present disclosure relates to a laundry treating apparatus, and more particularly, to a laundry treating apparatus having a rotator disposed in a drum.

Discussion of the Related Art

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

Therefore, it is an important task in the art to design the rotator such that the rotator may rotate to effectively improve the washing efficiency and the load on the rotation of the rotator may be effectively reduced.

SUMMARY

Embodiments of the present disclosure are to provide a laundry treating apparatus including a rotator designed to effectively improve a washing performance by guiding a water flow and laundry to an upper or lower portion of the rotator.

In addition, embodiments of the present disclosure are to provide a laundry treating apparatus including a rotator that forms a water flow that may effectively improve a washing performance even under a small load.

In addition, embodiments of the present disclosure are to provide a laundry treating apparatus including a rotator designed to minimize a tangling phenomenon of laundry resulted from rotation of the rotator.

In addition, embodiments of the present disclosure are to provide a laundry treating apparatus including a rotator designed to effectively reduce a load on rotation of the rotator to reduce power consumption.

A rotator disposed inside a drum may include a bottom portion and a pillar. The pillar may also be referred to as an agitator. The rotator according to an embodiment of the present disclosure may improve a washing efficiency and implement a washing scheme differentiated from a conventional scheme.

The bottom portion may also be referred to as a pulsator. In one embodiment of the present disclosure, a protrusion of the bottom portion may be constructed to have a shape of a whale tail and reduce resistance to wash water when rotating.

The protrusion of the bottom portion and the blade of the pillar may together form water flows at an upper portion and a lower portion of an interior of the drum together, thereby forming a differentiated water flow inside the drum and effectively improving a washing efficiency.

As the number of turns of the blade is equal to or less than ⅓, a flow amount of water in the longitudinal direction of the pillar per 1 rotation of the pillar may be increased and dynamic washing may be enabled. A water flow and laundry are continuously transferred to a blade positioned above by a protrusion of a bottom portion, so that a continuous force may be transferred from a lower portion to an upper portion of the drum, and the water flow may be formed.

The protrusion and the blade may implement a dynamic water flow formation and washing mode together. The blades may be divided into three bodies and disposed on the pillar. That is, the blades may be spaced apart from each other at an angle of 120 degrees with respect to a center of the pillar.

Ribs of the bottom portion, that is, the protrusion and the blade may be symmetrical, and the pillar may be formed in a hollow shape such that a thickness thereof gradually decrease upwardly.

The protrusion of the bottom portion may include a main protrusion, and the main protrusion may have a whale tail shape, that is, may have a side surface of a streamlined shape, so that a resistance to water may be effectively reduced and may have an effective linkage effect in a relationship with the blade.

As the number of turns of the blade is equal to or less than ⅓, a flow amount of water in the longitudinal direction of the pillar per 1 rotation of the pillar may be increased and dynamic washing may be enabled. A water flow and laundry are continuously transferred to a blade positioned above by a protrusion of a bottom portion, so that a continuous force may be transferred from a lower portion to an upper portion of the drum, and the water flow may be formed.

Such laundry treating apparatus according to an embodiment of the present disclosure may include a tub, a drum, and a rotator. Specifically, the tub provides therein a space for water to be stored, and the drum is rotatably disposed inside the tub, and includes an open surface for inserting and withdrawing laundry therethrough and a bottom surface located on an opposite side of the open surface.

The rotator is rotatably installed on the bottom surface and inside the drum. The rotator includes a bottom portion, a pillar, and a blade.

The bottom portion is positioned on the bottom surface, the pillar protrudes from the bottom portion toward the open surface, and the blade protrudes from an outer circumferential surface of the pillar.

The blade may be constructed such that one end thereof faces toward the bottom portion, and the other end thereof faces toward the open surface, and the blade may include a plurality of divided blades separated and spaced apart from each other between said one end and the other end.

The blade may extend obliquely with respect to the bottom portion to form a water flow.

The blade may include a plurality of blades disposed to be spaced apart from each other along a circumferential direction of the pillar, and a spaced distance between adjacent two of the plurality of blades may be maintained constant based on the circumferential direction of the pillar.

The blade may have one surface at least partially facing toward the open surface, and the other surface disposed on an opposite side of said one surface and at least partially facing toward the bottom portion, and the laundry treating apparatus may include a protrusion formed to protrude on at least one of said one surface and the other surface, and extending in parallel with an extension direction of the blade.

The plurality of divided blades may include a first divided blade and a second divided blade.

The first divided blade may include said one end of the blade, and the second divided blade may include the other end of the blade.

One end facing toward the bottom portion of the first divided blade may correspond to said one end of the blade, and the other end of the first divided blade may face toward the open surface.

The other end of the first divided blade may face said one end of the second divided blade.

The other end of the first divided blade may be disposed to overlap the second divided blade based on a circumferential direction of the pillar.

The blade may extend such that an inclination angle thereof with respect to the circumferential direction of the pillar is constant.

The first divided blade may extend obliquely with respect to the bottom portion, and an inclination angle of the first divided blade with respect to the bottom portion may increase as a distance to the second divided blade decreases.

The second divided blade may extend obliquely with respect to the bottom portion, and an inclination angle of the second divided blade with respect to the bottom portion may decrease as a distance to the first divided blade increases.

An inclination angle of said one end of the first divided blade may correspond to an inclination angle of the other end of the second divided blade.

An extension length of the first divided blade may correspond to an extension length of the second divided blade.

The pillar may be formed in a hollow shape with a space defined therein, and an opening may be defined in one surface of the pillar facing toward the open surface.

The rotator may further include a cap coupled to the pillar to close the opening.

The first divided blade may be disposed to be spaced apart from the bottom portion, and the second divided blade may be disposed to be spaced apart from the cap.

A protruding length from the pillar of the other end of the first divided blade may decrease as a distance to the second divided blade decreases, A protruding length from the pillar of said one end of the second divided blade may decrease as a distance to the first divided blade decreases.

A reduction rate of the protruding length from the pillar of the other end of the first divided blade may decrease as the distance to the second divided blade decreases.

A reduction rate of the protruding length from the pillar of said one end of the second divided blade may decrease as the distance to the first divided blade decreases.

Each of the features of the above-described embodiments may be implemented in combination in other embodiments as long as they are not contradictory or exclusive to other embodiments.

Embodiments of the present disclosure may provide the laundry treating apparatus including the rotator designed to effectively improve the washing performance by guiding the water flow and the laundry to the upper or lower portion of the rotator.

In addition, embodiments of the present disclosure may provide the laundry treating apparatus including the rotator that forms the water flow that may effectively improve the washing performance even under the small load.

In addition, embodiments of the present disclosure may provide the laundry treating apparatus including the rotator designed to minimize the tangling phenomenon of the laundry resulted from the rotation of the rotator.

In addition, embodiments of the present disclosure may provide the laundry treating apparatus including the rotator designed to effectively reduce the load on the rotation of the rotator to reduce the power consumption.

The effects of the present disclosure are not limited to the above, and other effects not mentioned will be clearly recognized by those skilled in the art from the description below.

DESCRIPTION OF SPECIFIC EMBODIMENTS

Figure 1:
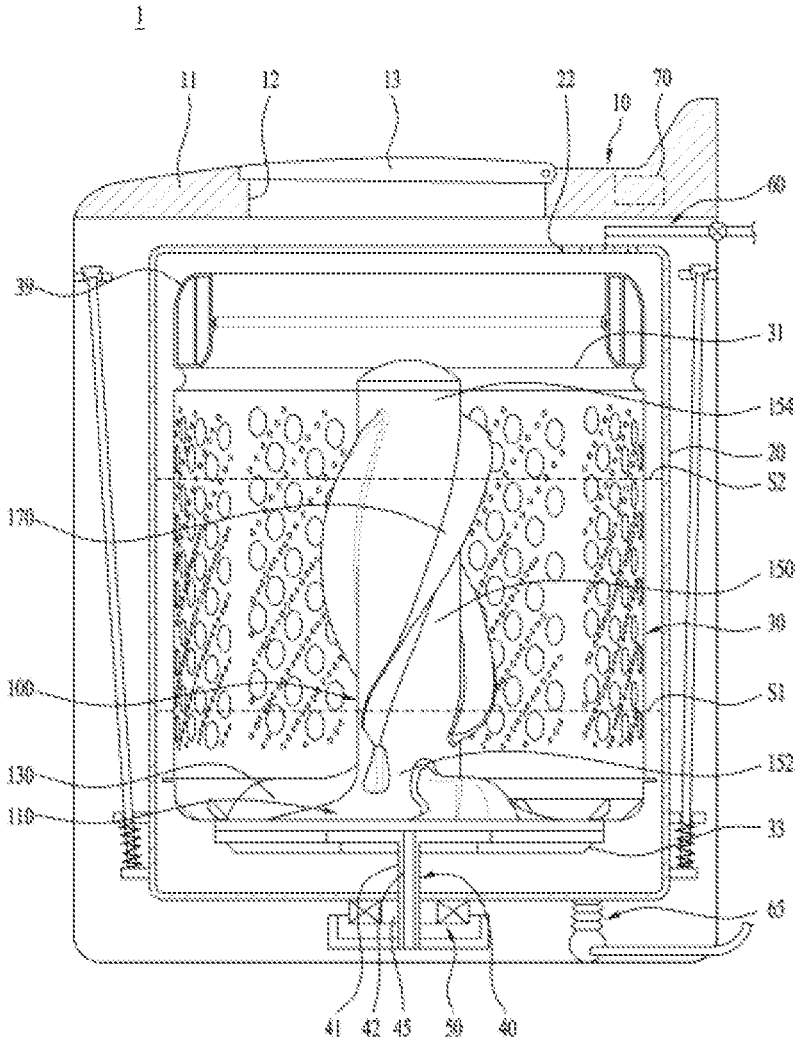
FIG. 1 is a view showing an interior of a laundry treating apparatus according to an embodiment of the present disclosure.

Hereinafter, embodiment disclosed herein will be described in detail with reference to the accompanying drawings. In the present specification, the same and similar reference numeral is assigned to the same and similar component even in different embodiments, and the description thereof is replaced by the first description. As used herein, the singular expression includes the plural expression unless the context clearly dictates otherwise. In addition, in describing the embodiments disclosed herein, when it is determined that a detailed description of a related known technology may obscure the gist of the embodiments disclosed herein, the detailed description thereof will be omitted. In addition, it should be noted that the accompanying drawings are only for making it easy to understand the embodiments disclosed herein, and the technical idea disclosed herein should not be construed as being limited by the accompanying drawings.

In addition, terms to be described later are terms defined in consideration of functions in the present disclosure, which may vary based on intentions or customs of users and operators. Therefore, the definitions thereof should be made based on the content throughout the present specification. The terms used in the detailed description are for describing the embodiments of the present disclosure only, and should in no way be limiting. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in describing the components of the embodiment of the present disclosure, terms such as first, second, A, B, (a), (b) may be used. Such terms are only for distinguishing one component from another component, and the essence, order, or sequence of the corresponding component are not limited by the terms.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10, and a laundry door 13 for opening and closing the laundry inlet 12 is disposed on the top surface 11 according to an embodiment of the present disclosure. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a tub support. The tub support may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, a drain pump disposed on the drain pipe, and a drain valve for controlling opening and closing of the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface 33 of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
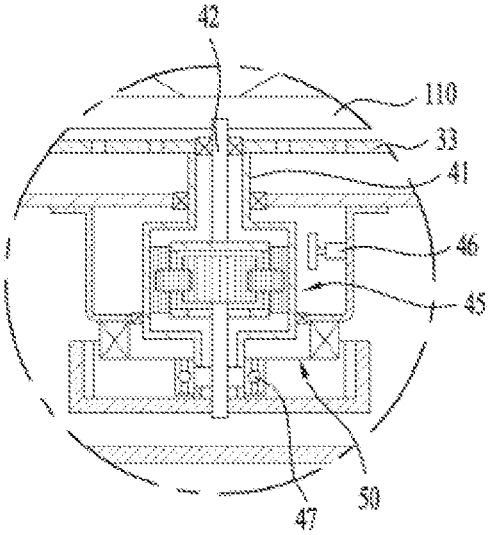
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 40 is coupled to the bottom surface 33 thereof, and the rotator 100 may be rotated by being coupled to a second rotation shaft 40 that passes through the bottom surface 33 and separately rotated with respect to the first rotation shaft 40.

The second rotation shaft 40 may rotate in a direction the same as or opposite to a rotation direction of the first rotation shaft 40. The first rotation shaft 40 and the second rotation shaft 40 may receive power through one driver 50, and the driver 50 may be connected to a gear set 45 that distributes the power to the first rotation shaft 40 and the second rotation shaft 40 and adjusts the rotation direction.

That is, a driving shaft of the driver 50 may be connected to the gear set 45 to transmit the power to the gear set 45, and each of the first rotation shaft 40 and the second rotation shaft 40 may be connected to the gear set 45 to receive the power.

The first rotation shaft 40 may be constructed as a hollow shaft, and the second rotation shaft 40 may be constructed as a solid shaft disposed inside the first rotation shaft 40. Accordingly, one embodiment of the present disclosure may effectively provide the power to the first rotation shaft 40 and the second rotation shaft 40 parallel to each other through the single driver 50.

FIG. 2 shows a planetary gear-type gear set 45, and shows a state in which each of the driving shaft, the first rotation shaft 40, and the second rotation shaft 40 is coupled to the gear set 45. Referring to FIG. 2, a rotational relationship of the first rotation shaft 40 and the second rotation shaft 40 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 40 coupled to the bottom surface 33 of the drum 30 may be connected to the ring gear positioned at the outermost portion of the gear set 45. The second rotation shaft 40 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 40 connected to the ring gear.

The second clutch element 47 may be constructed to mutually restrict or release the rotations of the driving shaft and the ring gear. That is, the rotation of the ring gear or the rotation of the first rotation shaft 40 may be synchronized with or desynchronized with the driving shaft by the second clutch element 47.

In one embodiment of the present disclosure, when the first clutch element 46 and the second clutch element 47 are in the releasing state, the first rotation shaft 40 and the second rotation shaft 40 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 40 are restricted, and the rotation of the second rotation shaft 40 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 40 are mutually restricted to each other, and the rotations of the driving shaft, the first rotation shaft 40, and the second rotation shaft 40 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 40, and the second rotation shaft 40 are all in the stationary state. The controller 70 may implement a necessary driving state by appropriately controlling the driver 50, the first clutch element 46, the second clutch element 47, and the like in the washing process, the rinsing process, and the like.

Figure 3:
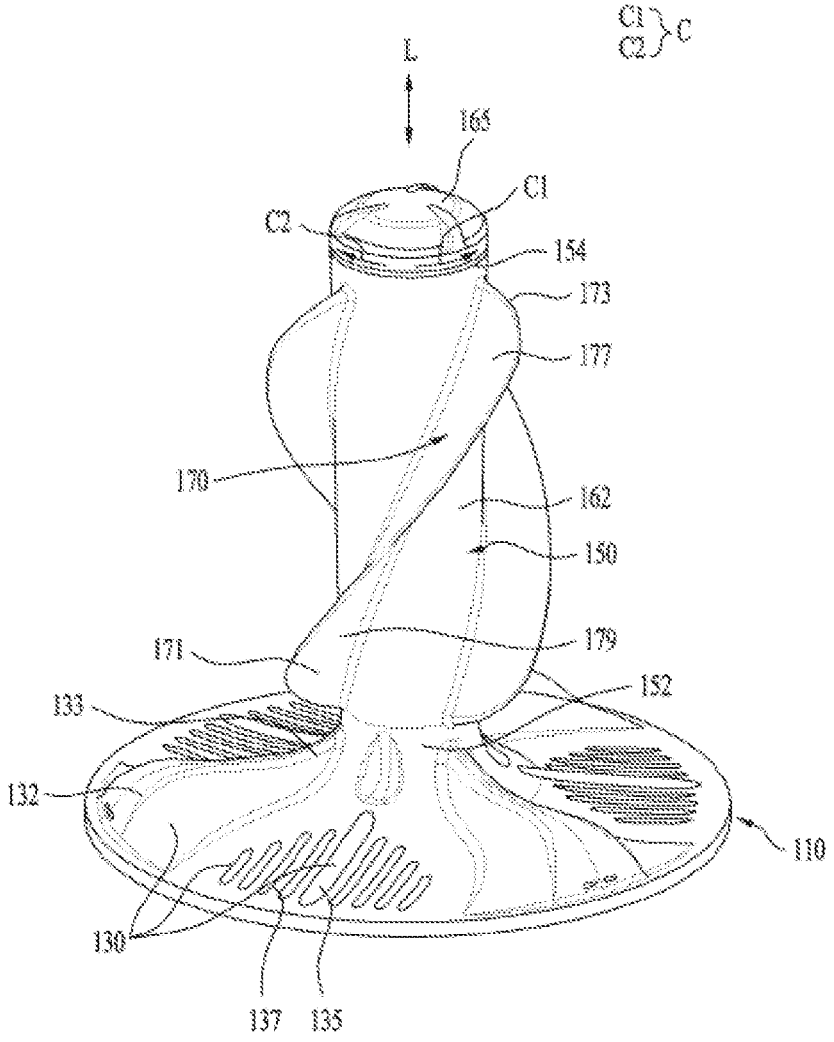
FIG. 3 is a perspective view showing a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 40 described above may be coupled to the bottom portion 110.

That is, the first rotation shaft 40 may be coupled to the drum 30, and the second rotation shaft 40 constructed as the solid shaft inside the hollow first rotation shaft 40 may penetrate the bottom surface 33 of the drum 30 and be coupled to the bottom portion 110 of the rotator 100.

The rotator 100 coupled to the second rotation shaft 40 may rotate independently with respect to the drum 30. That is, the rotator 100 may be rotated in the direction the same as or opposite to that of the drum 30, and such rotation direction may be selected by the controller 70 or the like when necessary.

The first rotation shaft 40 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 40 may be coupled to a center of the bottom portion 110 of the rotator 100. The second rotation shaft 40 may be coupled to one surface facing the drum 30, that is, a bottom surface of the bottom portion 110, or the second rotation shaft 40 may pass through a center of the drum 30 to be coupled to the bottom portion 110.

The bottom portion 110 may have a circular cross-section in consideration of balancing of the rotation. The bottom portion 110 may be rotated about the second rotation shaft 40 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances L5 between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 facing the bottom portion 110 to the other end 173 facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction C1 and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 may be inclined with respect to the longitudinal direction L of the pillar 150 over an entire length L2.

Figure 4:
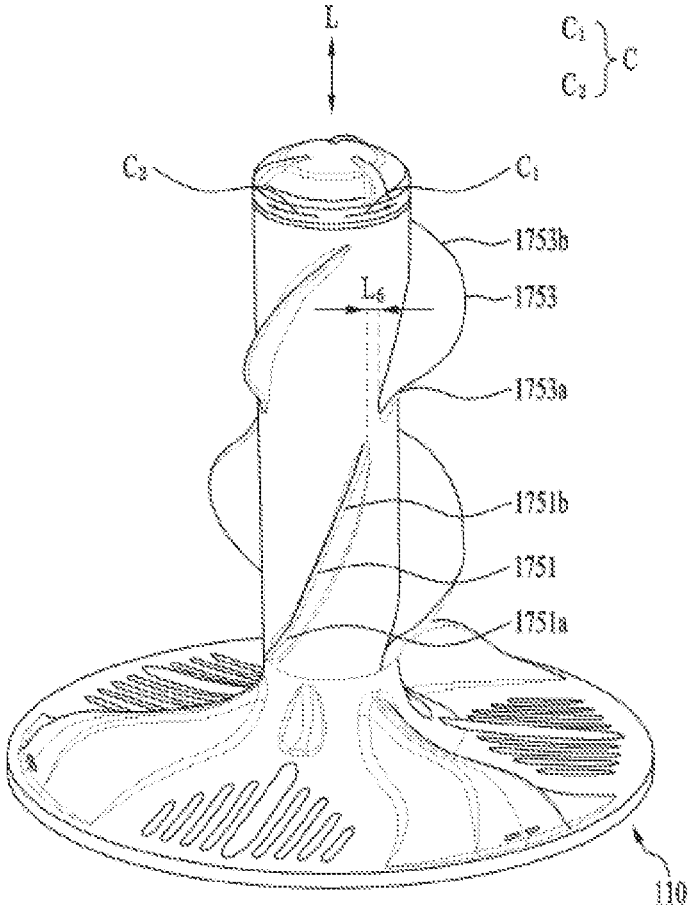
FIG. 4 is a view showing a blade composed of a plurality of divided bodies in a laundry treating apparatus according to an embodiment of the present disclosure.

In one example, FIG. 4 shows the rotator 100 in the laundry treating apparatus 1 according to another embodiment of the present disclosure. FIG. 4 is a view showing a blade 170 composed of a plurality of divided bodies in the laundry treating apparatus 1 according to an embodiment of the present disclosure.

Referring to FIG. 3, in one embodiment of the present disclosure, the blade 170 may be disposed on an outer circumferential surface of the pillar 150, and may be constructed such that said one end 171 faces toward the bottom portion 110 and the other end 173 faces toward the open surface 31.

The blade 170 may be composed of a plurality of divided blades 170 spaced apart from each other between said one end and the other end.

The plurality of divided blades 170 may include a first divided blade 1751 including said one end of the blade 170 and a second divided blade 1753 including the other end 173 of the blade 170.

In the first divided blade 1751, one end 1751*a* facing toward the bottom portion 110 may correspond to said one end 171 of the blade 170, and the other end 1751*b* may be disposed to face toward the open surface.

The second divided blade 1753 may be disposed such that one end 1753*a* faces toward the bottom portion 110, and the other end 1753*b* facing toward the open surface 31 may correspond to the other end 173 of the blade 170.

The first divided blade 1751 may be located higher than the second divided blade 1753 with respect to the longitudinal direction L of the pillar 150, and thus, located closer to the open surface 31. In addition, the second divided blade 1753 may be located lower than the first divided blade 1751, and thus, located closer to the bottom portion 110.

In FIG. 4, only the first divided blade 1751 and the second divided blade 1753, which are two divided bodies constituting the blade 170, are shown, but the present disclosure is not necessarily limited thereto. The blade 170 may be divided into three or more divided bodies.

In one example, the first divided blade 1751 and the second divided blade 1753 may extend along the longitudinal direction L of the pillar 150. In addition, the first divided blade 1751 and the second divided blade 1753 may be disposed on the outer circumferential surface of the pillar.

The first divided blade 1751 and the second divided blade 1753 may be uniformly disposed along the circumferential directions C1 and C2 of the pillar 150.

That is, a spaced distance L14 (see FIG. 8) between two adjacent first divided blades of a plurality of first divided blades 1751 may be constant. In addition, a spaced distance L14 (see FIG. 8) between two adjacent second divided blades of a plurality of second divided blades 1753 may be constant.

When viewed from the open surface 31 of the drum 30 of FIG. 1, the first divided blade 1751 and the second divided blade 1753 may be disposed to be spaced apart from each other at an angle of 120 degrees with respect to an axis of the pillar 150.

As shown in FIG. 4, as the blade 170 is composed of the first divided blade 1751 and the second divided blade 1753, which are the plurality of divided bodies, when the rotator 100 rotates, the resistance of water acting on the blade 170 may be reduced, and the load of the driver 50 with respect to the rotation of the rotator 100 may be reduced.

That is, even when a small amount of laundry is input and a small load acts on the rotator 100, as the first divided blade 1751 and the second divided blade 1753 are disposed to be spaced apart from each other, an area in which the laundry and the water flow in contact with the rotator 100 may be reduced, and power consumption may be reduced.

In addition, as the water flow and the wash water flow out between the first divided blade 1751 and the second divided blade 1753, when the rotator 100 rotates, loads on the first divided blade 1751 and the second divided blade 1753 may be effectively reduced to reduce the power consumption.

Figure 5:
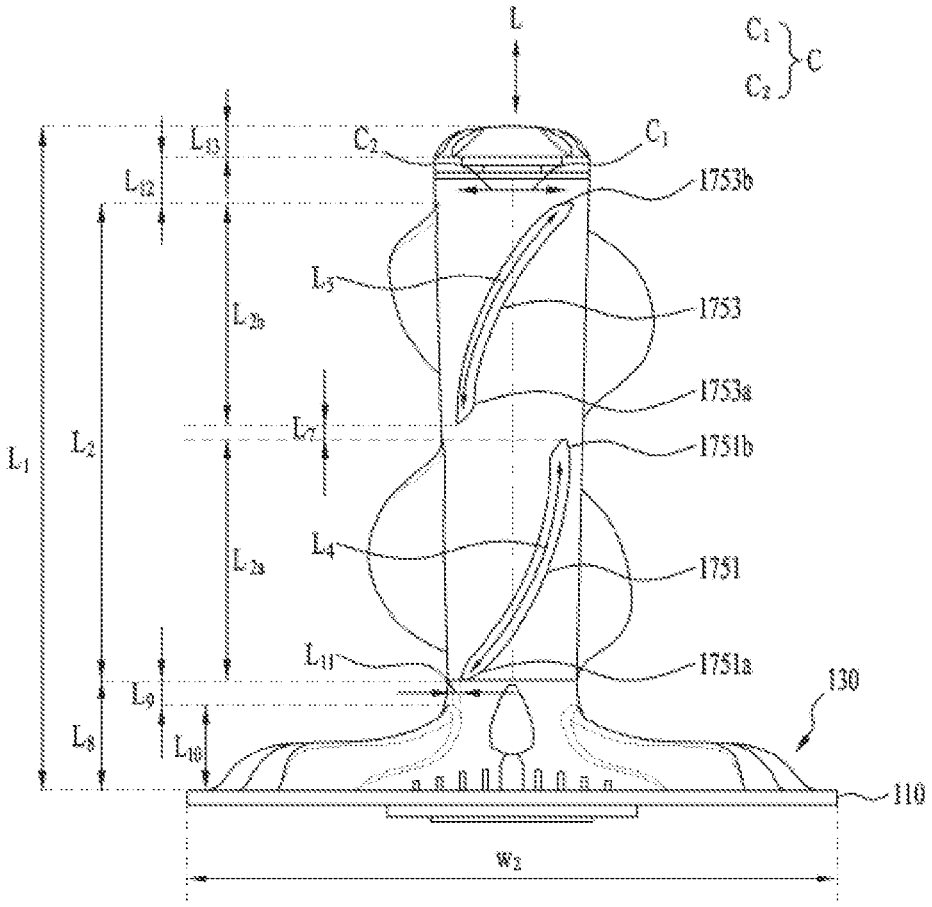
FIG. 5 is a view showing a rotator in a laundry treating apparatus according to an embodiment of the present disclosure viewed from the side.

In one example, FIG. 5 is a view of the rotator 100 of the laundry treating apparatus according to an embodiment of the present disclosure shown in FIG. 4 viewed from the side.

Referring to FIG. 5, in one embodiment of the present disclosure, the pillar 150 may extend from the top surface of the bottom portion 110 to an upper end of the pillar 150.

For example, in one embodiment of the present disclosure, a length L1 of the pillar 150 may be equal to or greater than 0.8 times and equal to or less than 1.2 times the diameter W2 of the bottom portion 110. However, the present disclosure is not necessarily limited thereto, and the length L1 of the pillar 150 may be equal to or greater than 0.9 times and equal to or less than 1.1 times the diameter W2 of the bottom portion 110.

That is, the length L1 of the pillar 150 may be related to a washing performance and the load of the driver 50. For example, when the length L1 of the pillar 150 is increased, the washing performance may be improved, but an excessive load may be applied to the driver 50. When the length L1 of the pillar 150 is reduced, the load on the driver 50 may be reduced, but the washing performance may also be reduced.

For example, when an amount of water supplied is large because of a large amount of laundry, but the length L1 of the pillar 150 is too small, because an area in which the water flow is formed by the pillar 150, the first divided blade 1751, and the second divided blade 1753 is reduced with respect to the drum 30, the washing performance may be deteriorated.

On the other hand, when the length L1 of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

Considering the above relationship, one embodiment of the present disclosure may determine a ratio between the length L1 of the pillar 150 and a diameter W2 of the bottom portion 110.

In addition, the length L1 of the pillar 150 may be variously determined in consideration of an inclination angle θ1 formed by the first divided blade 1751 with the bottom portion 110, an inclination angle θ2 formed by the second divided blade 1753 with the bottom portion 110, and the like to be described later.

In one example, the bottom portion 110 contributes to the formation of the water flow as a protrusion 130 or the like is formed thereon. Therefore, the relationship between lengths of the bottom portion 110 and the pillar 150 determines an effect of the water flow by the bottom portion 110 and an effect of the water flow by the pillar 150.

For example, with respect to various diameters W2 of the bottom portion 110 and lengths L1 of the pillar 150, ascending and descending of the laundry with the water may take place effectively when the length L1 of the pillar 150 is 0.8 times the diameter W2 of the bottom portion 110.

In addition, the load of the driver 50 with respect to the rotation of the rotator 100 may be properly maintained when the length L1 of the pillar 150 is equal to or less than 1.2 times the diameter W2 of the bottom portion 110.

That is, the diameter W2 of the bottom portion 110 may be variously determined in consideration of a diameter of the pillar 150, sizes of the tub 20 and the drum 30 of the laundry treating apparatus 1, a capacity of the laundry allowed in the laundry treating apparatus 1, an amount of water supplied resulted therefrom, and the like.

In one example, in one embodiment of the present disclosure, a height L2 from said one end 1751*a* of the first divided blade 1751 to the other end 1753*b* of the second divided blade 1753 may be equal to or greater than 0.5 times the total height L1 of the pillar 150 based on the longitudinal direction L of the pillar 150.

Specifically, as shown in FIG. 5, the height L2 from said one end 1751*a* of the first divided blade 1751 to the other end 1753*b* of the second divided blade 1753 may be defined as a vertical distance from said one end 1751*a* of the first divided blade 1751 to the other end 1753*b* of the second divided blade 1753 with respect to the top surface of the bottom portion 110.

In other words, the height L2 from said one end 1751*a* of the first divided blade 1751 to the other end 1753*b* of the second divided blade 1753 may be defined as a height of the blade 170.

The height L2 of the blade 170 may be determined in consideration of a relationship between an ascending amount and a descending amount of the water flow by the blade 170 and the load of the driver 50.

For example, as the height L2 of the blade 170 decreases, a region in which the blade 170 is formed decreases, and the ascending amount and the descending amount of the water flow may decrease.

In addition, as the height L2 of the blade 170 increases, the forming force of the water flow by the blade 170 may increase, but the load of the driver 50 may increase.

That is, the height L2 of the blade 170 may be determined in relation to an inclination angle θ1 of the first divided blade 1751 and an inclination angle θ2 of the second divided blade 1753 to be described later, the diameter of the pillar 150, and the like.

In one embodiment of the present disclosure, the height L2 of the blade 170 may be equal to or greater than 0.5 times the length L1 of the pillar 150. Accordingly, in one embodiment of the present disclosure, when the pillar 150 rotates, the blade 170 may form the effective ascending water flow and descending water flow inside the effective drum 30.

On the other hand, when the height L2 of the blade 170 is less than 0.5 times the length L1 of the pillar 150, the water flow formation by the blade 170 may be difficult to work effectively.

The height L2 of the blade 170 may be variously determined based on the size of the drum 30, the diameter W2 of the bottom portion 110, the height L1 of the pillar 150, the height of the protrusion 130, the position of the cap 190, and the like.

In one example, in one embodiment of the present disclosure, the first divided blade 1751 may extend from said one end 1751*a* to the other end 1751*b* on the outer circumferential surface of the pillar 150 toward the open surface 31 from the side of the bottom portion 110.

In addition, in one embodiment of the present disclosure, the second divided blade 1753 may extend from said one end 1753*a* to the other end 1753*b* on the outer circumferential surface of the pillar 150 toward the open surface 31 from the side of the bottom portion 110.

Specifically, the extension length L4 of the first divided blade 1751 from said one end 1751*a* to the other end 1751*b* may be equal to or greater than 0.7 times and equal to or less than 0.9 times the height L2 of the blade 170 from said one end 171 to the other end 173 based on the longitudinal direction L of the pillar 150. However, this means an optimal design value and the present disclosure is not necessarily limited thereto.

In addition, the extension length L5 of the second divided blade 1753 from said one end 1753*a* to the other end 1753*b* along the extension direction may also be equal to or greater than 0.7 times and equal to or less than 0.9 times the height L2 of the blade 170 from said one end 171 to the other end 173 based on the longitudinal direction L of the pillar 150. However, this also means an optimal design value and the present disclosure is not necessarily limited thereto.

In one example, the extension length L4 from said one end 1751*a* to the other end 1751*b* along the extension direction of the first divided blade 1751 may be defined as an extension length of the first divided blade 1751.

In addition, the extension length L5 from said one end 1753*a* to the other end 1753*b* along the extension direction of the second divided blade 1753 may be defined as an extension length of the second divided blade 1753.

For example, when the numbers of turns of the first divided blade 1751 and the second divided blade 1753 wound around the pillar 150 are increased at the same height L2 of the blade 170, the extension length L4 of the first divided blade 1751 and the extension length L5 of the second divided blade may be increased.

In addition, when the extension length L4 of the first divided blade 1751 and the extension length L5 of the second divided blade 1753 are large compared to the height L2 of the blade 170, because contact areas with water of the first divided blade 1751 and the second divided blade 1753 may be increased, and the inclination angle θ1 of the first divided blade 1751 and the inclination angle θ2 of the second divided blade 1753 may be increased, while the influence of the water flow formation on the wash water may be increased, the load on the driver 50 may also be increased.

On the other hand, when the extension length L4 of the first divided blade 1751 and the extension length L5 of the second divided blade 1753 are excessively reduced compared to the height L2 of the blade 170, the load of the driver 50 may be reduced, but the washing efficiency may be reduced due to excessively reduced water flow formation capacity.

Therefore, in the laundry treating apparatus 1 according to an embodiment of the present disclosure, a total length of the sum of the extension length L4 of the first divided blade 1751 and the extension length L5 of the second divided blade 1753 may be equal to or greater than 1.4 times the height L2 of the blade 170.

In addition, in order to effectively form the water flow, the laundry treating apparatus 1 according to one embodiment of the present disclosure may secure the inclination angle θ1 of the first divided blade 1751 and the inclination angle θ2 of the second divided blade 1753, and the first divided blade 1751 and the second divided blade 1753 may effectively secure the contact areas with the wash water inside the drum 30.

In addition, the total length of the sum of the extension length L4 of the first divided blade 1751 and the extension length L5 of the second divided blade 1753 is equal to or less than 1.8 times the height L2 of the blade 170, which may be advantageous for formation of a rotational water flow by the first divided blade 1751 and the second divided blade 1753 while the load of the driver 50 does not deviate from an allowable range.

Therefore, the total length of the sum of the extension length L4 of the first divided blade 1751 and the extension length L5 of the second divided blade 1753 may be variously determined based on the height L2 of the blade 170, the diameter of the pillar 150, the inclination angles θ1 and θ2 of the first divided blade 1751 and the second divided blade 1753, the load amount of the driver 50, the water flow formation level, and the like.

In one example, the first divided blade 1751 and the second divided blade 1753 may be disposed on the outer circumferential surface of the pillar 150 such that the extension length L4 of the first divided blade 1751 and the extension length L5 of the second divided blade 1753 correspond to each other.

As the extension length L4 of the first divided blade 1751 and the extension length L5 of the second divided blade 1753 correspond to each other, when the first divided blade 1751 and the second divided blade 1753 are integrally formed with the pillar 150, it is possible to reduce a production cost of a mold apparatus for manufacturing the rotator 100, and increase durability of the rotator 100.

In one example, as shown in FIGS. 4 and 5, the first divided blade 1751 and the second divided blade 1753, which are formed by dividing the blade 170, may be disposed on the outer circumferential surface of the pillar 150 to face each other.

That is, the other end 1751*b* of the first divided blade 1751 may be disposed to face said one end 1753*a* of the second divided blade 1753.

The ascending water flow may be formed at the first divided blade 1751 based on the rotation direction of the rotator 100. In this case, as the first divided blade 1751 and the second divided blade 1753 are disposed to face each other, the ascending water flow formed at the first divided blade 1751 may be guided to the second divided blade 1753 with constant intensity and direction of the water flow.

Conversely, the descending water flow may be formed at the first divided blade 1751 based on the rotation direction of the rotator 100. In this case, as the first divided blade 1751 and the second divided blade 1753 are disposed to face each other, the descending water flow formed at the first divided blade 1751 may be guided to the second divided blade 1753 with constant intensity and direction of the water flow.

In one example, as shown in FIGS. 4 and 5, the other end 1751*b* of the first divided blade 1751 and said one end 1753*a* of the second divided blade may be disposed to be spaced apart from each other by a predetermined distance.

A spaced distance between the other end 1751*b* of the first divided blade 1751 and said one end 1753*a* of the second divided blade 1753 may be defined as a length L6 from the other end 1751*b* of the first divided blade 1751 to said one end 1753*a* of the second divided blade 1753 based on the circumferential direction C of the pillar 150, and a length L7 from the other end 1751*b* of the first divided blade 1751 to said one end 1753*a* of the second divided blade 1753 based on the longitudinal direction L of the pillar 150.

The spaced distances L6 and L7 between the other end 1751*b* of the first divided blade 1751 and said one end 1753*a* of the second divided blade 1753 may be sufficient large to prevent the laundry from being tangled in the space between the first divided blade 1751 and the second divided blade 1753.

However, when the spaced distances L6 and L7 are too large, the laundry and the water flow may excessively pass through the space defined between the first divided blade 1751 and the second divided blade 1753, so that the ascending water flow or the descending water flow may not be formed, which may directly result in reduced washing performance.

Accordingly, the spaced length L6 based on the circumferential direction C of the pillar 150 and the spaced length L7 based on the longitudinal direction L of the pillar 150 may be variously determined in consideration of the sizes of the tub 20 and the drum 30 of the laundry treating apparatus 1, the diameter of the pillar 150, the number of turns the blade 170 wound around the pillar 150, an allowable capacity of the laundry, and a water supply amount resulted therefrom.

Figure 6:
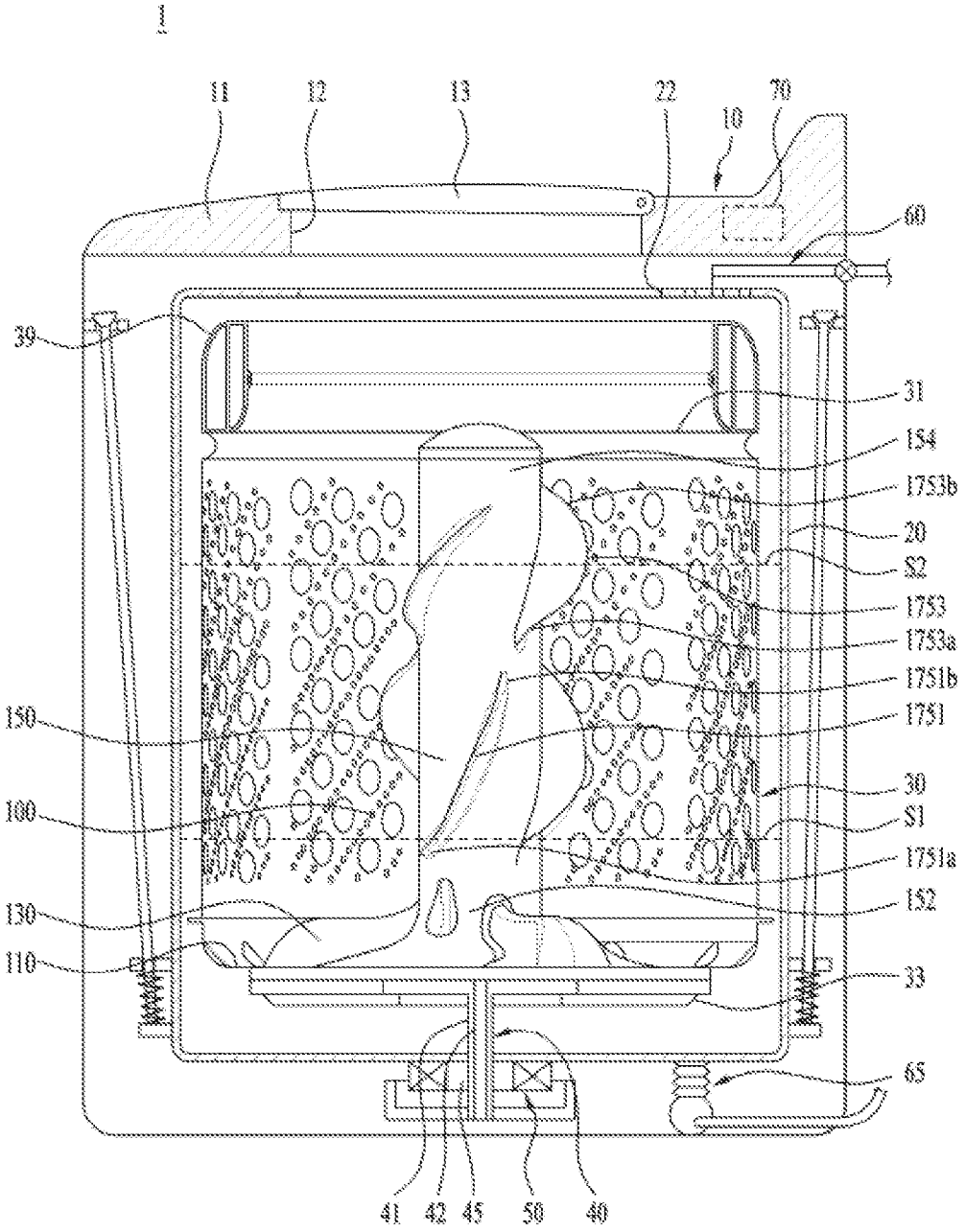
FIG. 6 is a view showing a drum and a rotator in a laundry treating apparatus according to an embodiment of the present disclosure.

FIG. 6 is a view showing the drum 30 and the rotator 100 in the laundry treating apparatus 1 according to an embodiment of the present disclosure.

As shown in FIGS. 5 and 6, one embodiment of the present disclosure may allow said one end 1751*a* of the first divided blade 1751 to be always immersed in the wash water in the washing process or the rinsing process, so that the water flow formation effect by the rotation of the rotator 100 may occur effectively.

To this end, a height L8 of said one end 1751*a* of the first divided blade 1751 may be equal to or less than 0.25 times the diameter W1 of the drum 30. However, this means an optimal design value and the present disclosure is not necessarily limited thereto.

Specifically, the vertical level L8 of said one end 1751*a* of the first divided blade 1751 may be specifically determined based on the minimum amount of water supplied and the diameter W1 of the drum 30. For example, the larger the minimum amount of water supplied, the higher the vertical level L8 of said one end 1751*a* of the first divided blade 1751 may be determined. In addition, the larger the diameter W1 of the drum, the lower the vertical level L8 of said one end 1751*a* of the first divided blade 1751.

In one embodiment of the present disclosure, the minimum amount of water supplied may be the amount of water supplied for the amount of laundry of 8 lb as described above. Considering the diameter W1 of the drum 30 that is usually determined therefor, the height L8 of said one end 1751*a* of the first divided blade 1751 may be equal to or less than 0.25 times the diameter W1 of the drum 30, and the vertical level L8 may be lower than the vertical level of the water surface S1.

When the height L8 of said one end 1751*a* of the first divided blade 1751 exceeds 0.25 times the diameter W1 of the drum 30, the diameter W1 of the drum 30 may become smaller than necessary in order for the vertical level L8 of said one end 1751*a* of the first divided blade 1751 to be lower than the vertical level of the water surface S1 of the minimum amount of water supplied. In this case, an allowable amount of laundry in the laundry treating apparatus 1 may be excessively reduced, which may be disadvantageous.

In one example, the length L1 of the pillar 150 may be variously determined in consideration of a diameter W1 of the drum 30 as well as a height of the drum 30, a diameter of the pillar 150, and the like.

One embodiment of the present disclosure determines an allowable ratio between the length L1 of the pillar 150 and the diameter W2 of the bottom portion 110. Accordingly, the rotator 100 in which the load of the driver 50 is within an allowable range while the formation of the water flow by the pillar 150 is effectively achieved may be implemented.

In one example, in one embodiment of the present disclosure, the diameter W2 of the bottom portion 110 may be equal to or greater than 0.7 times and equal to less than 0.9 times the diameter W1 of the drum 30. However, the present disclosure is not necessarily limited thereto.

Because the bottom portion 110 is positioned on the bottom surface 33 of the drum 30 and rotated, the diameter W2 of the bottom portion 110 with respect to the diameter W1 of the drum 30 needs to be considered. When the diameter W2 of the bottom portion 110 is too small, the effect of the water flow by the rotation of the bottom portion 110 may be too small. When the diameter W2 of the bottom portion 110 is too large, it is easy to cause jamming of the laundry and is disadvantageous in the rotation by the load of the driver 50 and the like.

Considering the above relationship, in one embodiment of the present disclosure, the diameter W2 of the bottom portion 110 is equal to or greater than 0.7 times the diameter W1 of the drum 30, which allows the effect of the water flow by the rotation of the bottom portion 110 with respect to an entirety of the drum 30 to be effective. In addition, the diameter W2 of the bottom portion 110 is equal to or less than 0.9 times the diameter W1 of the drum 30, which prevents the jamming of the laundry and minimizes the load of the rotation.

That is, the diameter W1 of the drum 30 may be variously determined in consideration of the capacity of the laundry allowed in the laundry treating apparatus 1, the amount of water supplied, and a relationship with the tub 20.

In one example, one embodiment of the present disclosure may include the water supply 60 and the controller 70 as described above. The water supply 60 may be constructed to supply the water into the tub 20, and the controller 70 may control the water supply 60 in the washing process to adjust the amount of water supplied.

The controller 70 may control the water supply 60 such that the amount of water supplied preset based on an amount of laundry selected by the user through the manipulation unit in the washing process is supplied into the tub 20.

For example, when the user selects a minimum amount as the amount of laundry or when the amount of laundry is identified to be the minimum amount through a sensor or the like, a minimum amount of water supplied corresponding to the minimum amount of laundry may be preset in the controller 70, and the controller 70 may control the water supply 60 such that the minimum amount of water supplied is supplied into the tub 20.

In addition, when the amount of laundry is identified as a maximum amount by the user, the sensor, or the like, a maximum amount of water supplied corresponding to the maximum amount of laundry may be preset in the controller 70, and the controller 70 may control the water supply 60 such that the maximum amount of water supplied is supplied into the tub 20.

There may be various minimum criteria for the amount of laundry. For example, in a standard washing capacity test in the United States, an amount of laundry of 3 kg or an amount of laundry of 8 lb is presented as a small amount criteria. In one embodiment of the present disclosure, the minimum amount of water supplied may be an amount of water supplied preset for the laundry amount corresponding to 8 lb. In addition, there may be various maximum criterion for the amount of laundry.

As shown in FIG. 6, in one embodiment of the present disclosure, a water surface S1 corresponding to the minimum amount of water supplied and a water surface S2 corresponding to the maximum amount of water supplied may be formed inside the tub 20.

In one embodiment of the present disclosure, the controller 70 may control the water supply 60 such that the amount of water supplied is equal to or greater than the preset minimum amount of water supplied in the washing process, and the first divided blade 1751 may be constructed such that the vertical level L8 of said one end 1751*a* with respect to the bottom portion 110 shown in FIG. 5 is equal to or lower than a vertical level of the water surface S1 corresponding to the minimum amount of water supplied.

When the first divided blade 1751 is not submerged in the water, even when the rotator 100 rotates, the ascending water flow and the descending water flow by the first divided blade 1751 are not formed, which may be disadvantageous.

Therefore, in one embodiment of the present disclosure, in the washing process, at least the minimum amount of water supplied may be supplied into the tub 20, and said one end 171 of the blade 170 may be positioned at a vertical level equal to or lower than the vertical level of the water surface S1 corresponding to the preset minimum amount of water supplied such that the blade 171 may be always positioned at a vertical level equal to or lower than a vertical level of a water surface and submerged in the water despite a change in the amount of water supplied.

The minimum amount of water supplied may be the amount of water supplied for the amount of laundry of 8 lb, which is a criteria of a small load test in the authorized laundry test in the United States, as described above.

When the pillar 150 protrudes upward from the bottom portion 110 as shown in FIGS. 5 and 6, the vertical level L8 of said one end 1751*a* of the first divided blade 1751 may correspond to a distance from the bottom portion 110 in a vertical upward direction.

In one embodiment of the present disclosure, as the height L8 of said one end of the first divided blade 1751 is equal to or less than 0.25 times the diameter W1 of the drum 30, even at the minimum amount of water supplied, said one end 1751*a* of the first divided blade 1751 is able to be in contact with the water and at the same time, the diameter W1 of the drum 30 is able to be sufficiently secured, which may be advantageous for the washing performance.

In one example, in one embodiment of the present disclosure, as for the first divided blade 1751, said one end 1751*a* may be located below a water surface of the water stored in the tub 20 and the other end 1753*b* may be located above the water surface in the washing process.

In FIG. 6, the vertical level of the water surface S1 at the minimum amount of water supplied and the vertical level of the water surface S2 at the maximum amount of water supplied, according to an embodiment of the present disclosure are indicated. FIG. 6 shows that said one end 1751*a* of the first divided blade 1751 is located at a vertical level closer to the bottom portion 110 than the vertical level of the water surface S1 based on the minimum amount of water supplied, and the other end 1753*b* of the second divided blade 1753 is located at a vertical level further from the bottom portion 110 than the vertical level of the water surface S2 based on the maximum amount of water supplied.

In one embodiment of the present disclosure, the other end 173 of the blade 170 is disposed to be spaced apart from the water surface of the water stored in the tub 20 toward the open surface 31 at all times, so that the water flow by the blade 170 may always be formed up to an upper portion of the water even when the amount of water stored in the tub 20 is changed in the washing process.

The position of the other end 1753*b* of the second divided blade 1753 may be determined in consideration of various factors such as the diameter W1 of the drum 30, the maximum amount of water supplied, the length L1 of the pillar 150, and the like.

In one example, in the laundry treating apparatus 1 according to one embodiment of the present disclosure, the controller 70 may control the water supply 60 such that the amount of water supplied is equal to or less than the preset maximum amount of water supplied in the washing process. In addition, the blade 170 may be constructed such that the vertical level of the other end 1753*b* of the second divided blade 1753 with respect to the bottom portion 110 may be equal to or higher than the vertical level of the water surface S2 corresponding to the maximum amount of water supplied.

The amount of water supplied to the tub 20 may vary based on the amount of laundry or the result of manipulation of the manipulation unit by the user. One embodiment of the present disclosure allows the other end 1753*b* of the second divided blade 1753 to be located at the vertical level equal to or higher than the vertical level of the water surface S2 even for the maximum amount of water supplied that may be provided to the tub 20 in the washing process, so that the water flow by the first divided blade 1751 and the second divided blade may be formed up to the upper portion of the water stored in the tub 20 even when the amount of water supplied is changed.

Figure 7:
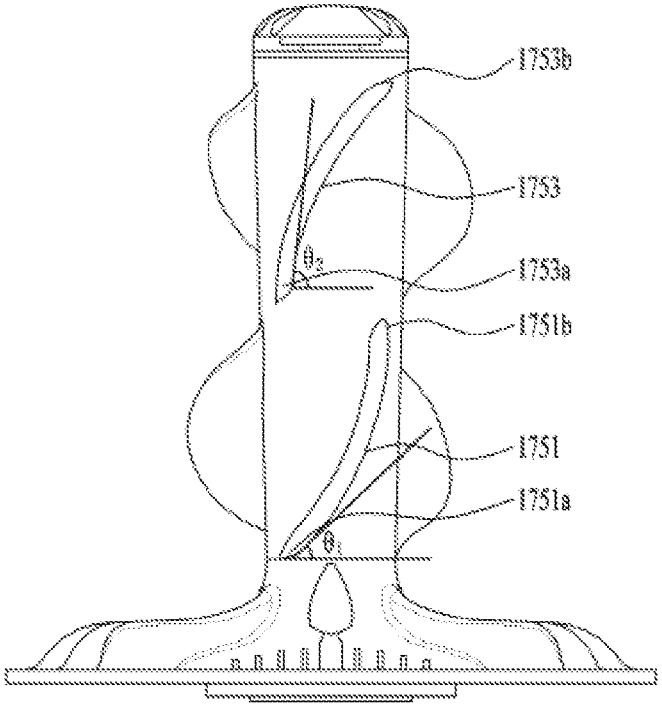
FIG. 7 is a view showing an extension angle of a divided blade in a laundry treating apparatus according to an embodiment of the present disclosure.

In one example, FIG. 7 is a view showing an extension angle of a divided blade in a laundry treating apparatus according to an embodiment of the present disclosure.

Referring to FIG. 7, in one embodiment of the present disclosure, the first divided blade 1751 may be disposed on the outer circumferential surface of the pillar 150 and extend from said one end 1751*a* to the other end 1751*b* while forming the inclination angle θ1 with respect to the circumferential direction (hereinafter, C) (see FIG. 5) of the pillar 150.

In addition, the second divided blade 1753 may be disposed on the outer circumferential surface of the pillar 150 and may extend from said one end 1753*a* to the other end 1753*b* while forming the inclination angle θ2 with respect to the circumferential direction C of the pillar 150.

Specifically, the first divided blade 1751 and the second divided blade 1753 may extend on the outer circumferential surface of the pillar 150 in a shape inclined with respect to the longitudinal direction L or the circumferential direction C of the pillar 150.

That is, the inclination angles θ1 and θ2 respectively formed by the first divided blade 1751 and the second divided blade 1753 with respect to the circumferential direction C of the pillar 150 may be understood to have the same meaning as inclination angles θ1 and θ2 respectively formed by the first divided blade 1751 and the second divided blade 1753 with respect to the bottom portion 110.

The inclination angle θ1 of the first divided blade 1751 and the inclination angle θ2 of the second divided blade 1753 may be variously determined in relation to the length L1 of the pillar 150, the diameter of the pillar 150, the number of turns of the blade 170, and the like.

When the inclination angle θ1 of the first divided blade 1751 and the inclination angle θ2 of the second divided blade 1753 with respect to the bottom portion 110 are too small, vertical dimensions L2 occupied by the first divided blade 1751 and the second divided blade 1753 in the pillar 150 are too small with respect to the constant numbers of turns of the first divided blade 1751 and the second divided blade 1753, so that a water flow formation effect may be reduced.

In addition, when the inclination angle θ1 of the first divided blade 1751 and the inclination angle θ2 of the second divided blade 1753 are too large, mechanical loads acting on the first divided blade 1751, the second divided blade 1753, and the pillar 150 when the rotator 100 rotates may be increased, the load of the driver 50 may also be increased, and an ascending and descending effect of the water for the same number of turns of the rotator 100 may be reduced, which may be disadvantageous.

Considering results of a number of experiments, in one embodiment of the present disclosure, when the inclination angle θ1 of the first divided blade 1751 and the inclination angle θ2 of the second divided blade 1753 are smaller than 35 degrees, the numbers of turns of the first divided blade 1751 and the second divided blade 1753 may be excessively increased or a vertical distance L2 between the first divided blade 1751 and the second divided blade 1753 may be excessively reduced, so that the water flow forming effect may be reduced. When the inclination angle θ1 of the first divided blade 1751 and the inclination angle θ2 of the second divided blade 1753 exceed 80 degrees, the ascending and descending effect of the water may be excessively reduced, and the resistance by the water may be too large.

Considering the above effective changes, one embodiment of the present disclosure may allow the inclination angle θ1 of the first divided blade 1751 and the inclination angle θ2 of the second divided blade 1753 to be equal to or larger than 35 degrees and equal to or smaller than 80 degrees based on the circumferential direction C of the pillar 150 or the bottom portion 110.

The inclination angle θ1 of the first divided blade 1751 and the inclination angle θ2 of the second divided blade 1753 may be, for example, 35, 42, 45, or 70 degrees, and may be strategically determined in consideration of the length L1 of the pillar 150 and the level of water flow formation.

However, the numerical values for the inclination angle θ1 of the first divided blade 1751 and the inclination angle θ2 of the second divided blade 1753 are only for convenience of description and do not limit the invention, and may allow a normal error range that may occur during manufacturing.

In one example, as shown in FIG. 7, the first divided blade 1751 may extend to increase the inclination angle θ1 with respect to the bottom portion 110 as a distance to the second divided blade 1753 is decreased.

That is, the first divided blade 1751 may form an inclination angle formed by a virtual tangent line (not shown) with the bottom portion 110 with respect to the extension direction from said one end 1751*a* to the other end 1751*b*.

The inclination angle θ1 formed by the virtual tangent line (not shown) with the bottom portion 110 may increase toward the other end 1751*b*.

An inclination angle formed by said one end 1751*a* of the first divided blade 1751 with the bottom portion 110 may be smaller than an inclination angle formed by the other end 1751*b* of the first divided blade 1751 with the bottom portion 110.

For example, the inclination angle formed by said one end 1751*a* of the first divided blade 1751 with the bottom portion 110 may be equal to or larger than 35 degrees, and the inclination angle formed by the other end 1751*b* of the first divided blade 1751 and the bottom portion 110 may be equal to or smaller than 80 degrees.

In addition, as shown in FIG. 7, the second divided blade 1753 may extend to decrease the inclination angle θ2 with respect to the bottom portion 110 as a distance to the first divided blade 1751 is increased.

That is, the second divided blade 1753 may form an inclination angle formed by a virtual tangent line (not shown) with the bottom portion 110 with respect to the extension direction from said one end 1753*a* to the other end 1753*b*.

The inclination angle formed by the virtual tangent line (not shown) with the bottom portion 110 may decrease toward the other end 1753*b*.

An inclination angle formed by said one end 1753*a* of the second divided blade 1753 with the bottom portion 110 may be larger than an inclination angle formed by the other end 1753*b* of the second divided blade 1753 with the bottom portion 110.

For example, the inclination angle formed by said one end 1753*a* of the second divided blade 1753 with the bottom portion 110 may be equal to or smaller than 80 degrees, and the inclination angle formed by the other end 1753*b* of the second divided blade 1753 and the bottom portion 110 may be equal to or larger than 35 degrees.

As the inclination angle θ1 of the first divided blade 1751 increases as the distance to the second divided blade 1753 is decreased, and the inclination angle θ2 of the second divided blade 1753 decreases as the distance to the first divided blade 1751 is increased, when looking at the rotator 100 from the side of the pillar 150, the first divided blade 1751 and the second divided blade 1753 may be formed in an S-shape.

In addition, as the inclination angle θ1 of the first divided blade 1751 increases as the distance to the second divided blade 1753 is decreased, a speed of the water flow guided from said one end 1751*a* to the other end 1751*b* of the first divided blade 1751 may increase as the water flow approaches the other end 1751*b*.

In addition, as the inclination angle θ1 of the other end 1751*b* of the first divided blade 1751 with respect to the bottom portion 110 is rapidly increased, a flow direction of the formed water flow may gradually become parallel to the longitudinal direction L of the pillar 150.

As a result, the flow direction of the water flow may become perpendicular to the rotation direction of the rotator 100, that is, the circumferential direction C (see FIG. 5) of the pillar, and an amount of water flow formed by the first divided blade 1751 leaked into a space defined between the first divided blade 1751 and the second divided blade 1753 spaced apart from each other may be reduced.

Hereinabove, only the case in which the ascending water flow occurs has been described, but such effect may be equally generated even when the descending water flow occurs.

In addition, as the inclination angle θ2 of the second divided blade 1753 decreases as the distance from the first divided blade 1751 increases, The speed of the water flow guided from said one end 1753*a* to the other end 1753*b* of the second divided blade 1753 may become lower as the water flow approaches the other end 1751*b*.

As described above, the other end 1753*b* of the second divided blade 1753 may be located farther from the bottom portion 110 than the water surface S2 (see FIG. 6) based on the maximum water supply amount inside the tub 20.

In the washing process, the water flow ascended after passing through the second divided blade 1753 may descend to the bottom portion 110 while in contact with the inner circumferential surface of the drum 30. In this case, a descending speed may increase as a speed of the water flow passed through the other end 1753*b* of the second divided blade 1753 decreases. As the descending speed increases, the water flow inside the drum 30 may actively ascend or descend, and as a result, the washing efficiency may be increased.

In addition, when the speed of the water flow passed through the other end 1753*b* of the second divided blade 1753 is too high, a frequency of occurrence of vortices on the water surface S2 increases, and a risk that wash water mixed with detergent may be exposed to the user outside the water surface S2 increases, which may result in a decrease in user convenience and washing efficiency.

Figure 8:
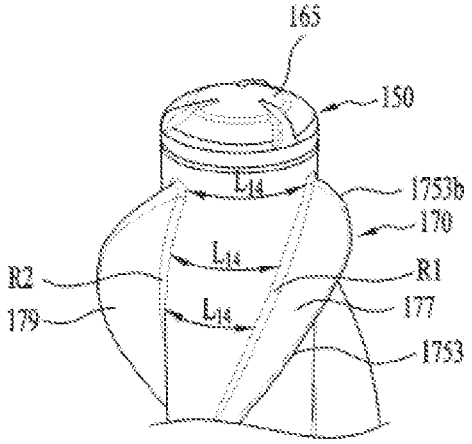
FIG. 8 shows divided blades spaced apart from each other in a laundry treating apparatus according to an embodiment of the present disclosure.

In one example, FIG. 8 shows second divided blades spaced apart from each other along the circumferential direction C of pillar 150. Referring to FIG. 8, the second divided blade 1753 may extend from said one end 1753*a* to the other end 1753*b* while maintaining the spaced distance L14 between the two adjacent second divided blades constant based on the circumferential direction C of the pillar 150.

In one embodiment of the present disclosure, the spaced distance L14 between the two adjacent second divided blades may be maintained constant based on the circumferential direction C of the pillar 150 along the longitudinal direction L of the pillar 150. The spaced distance L14 between the two adjacent second divided blades may be always maintained constant throughout the pillar 150.

Although not shown, the first divided blade 1751 may also extend from said one end 1751*a* to the other end 1751*b* while maintaining the spaced distance L14 between the two adjacent first divided blades constant based on the circumferential direction C of the pillar 150 in the same manner.

Figure 9:
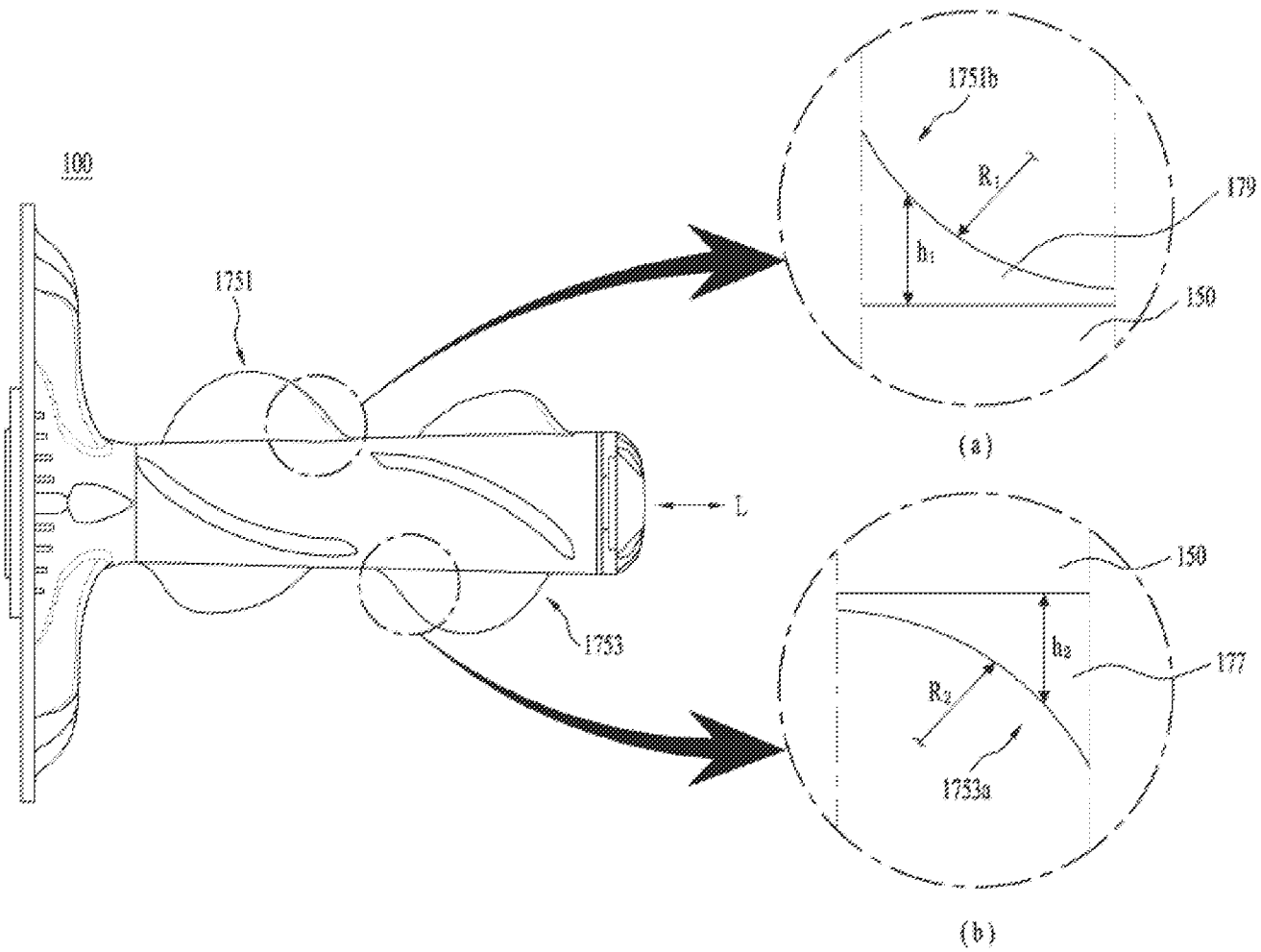
FIG. 9 is a drawing showing enlarged cross-sections of divided blades at a division point in a laundry treating apparatus according to an embodiment of the present disclosure.

In one example, FIG. 9 is a drawing showing enlarged cross-sections of divided blades at a division point in a laundry treating apparatus according to an embodiment of the present disclosure. (a) in FIG. 9 is a view of the other end 1751*b* of the first divided blade 1751 viewed in a direction of the other surface 179. (b) in FIG. 9 is a view of said one end 1753*a* of the second divided blade 1753 viewed in a direction of the one surface 177.

As shown in FIG. 9, a protruding length h1 from the pillar 150 of the other end 1751*b* of the first divided blade 1751 may be reduced in a direction toward the second divided blade 1753.

In addition, a protruding length h2 from the pillar of said end 1753*a* of the second divided blade 1753 may be reduced in a direction toward the first divided blade 1751.

As described above in FIG. 5, the other end 1751*b* of the first divided blade 1751 and said one end 1753*a* of the second divided blade 1753 may be sufficiently spaced apart from each other to prevent the jamming or the tangling of the laundry in the washing process. However, when the spaced distance therebetween is too large, the ascending water flow or the descending water flow flows out into the space defined between the other end 1751*b* of the first divided blade 1751 and said one end 1753*a* of the second divided blade 1753, which may excessively lower the washing efficiency.

Therefore, as the other end 1751*b* of the first divided blade 1751 is closer to the second divided blade 1753, the protruding length h1 from the pillar 150 may be reduced. In addition, as said one end 1753*a* of the second divided blade 1753 is closer to the first divided blade 1751, the protruding length h2 from the pillar may be reduced.

That is, the protruding length h1 of the other end 1751*b* of the first divided blade 1751 may be defined as a vertical distance of the other end 1751*b* of the first divided blade 1751 protruding in a direction of the inner circumferential surface of the drum 30 from the outer circumferential surface of the pillar where the first divided blade 1751 and the pillar 150 are in contact with each other.

In addition, that is, the protruding length h2 of said one end 1753*a* of the second divided blade 1753 may be defined as a vertical distance of said one end of the second divided blade 1753 protruding in a direction of the inner circumferential surface of the drum 30 from the outer circumferential surface of the pillar 150 where the second divided blade 1753 and the pillar 150 are in contact with each other.

In one example, the closer to the second divided blade 1753, the smaller the reduction rate of the protruding length h1 from the pillar 150 of the other end 1751*b* of the first divided blade 1751. In addition, the closer to the first divided blade 1751, the smaller the reduction rate of the protruding length from the pillar 150 of said one end 1753*a* of the second divided blade 1753.

A parting line (not shown) may be formed on one surface of each of the first divided blade 1751 and the second divided blade 1753 facing the inner circumferential surface of the drum 30 during the injection molding process. The parting line may be defined as a groove or a protrusion of an injection product produced between a plurality of mold apparatuses during the injection molding process.

The parting line may have a plurality of sharp edges, and may induce damage to the laundry when formed on the first divided blade 1751 and the second divided blade 1753.

That is, in order to effectively prevent the jamming or the tangling of the laundry, and to prevent the damage to the laundry that may be caused by the first divided blade 1751 and the second divided blade 1753, the closer to the second divided blade 1753, the smaller the reduction rate of the protruding length h1 from the pillar 150 of the other end 1751*b* of the first divided blade 1751, and the closer to the first divided blade 1751, the smaller the reduction rate of the protruding length from the pillar 150 of said one end 1753*a* of the second divided blade 1753.

Figure 10:
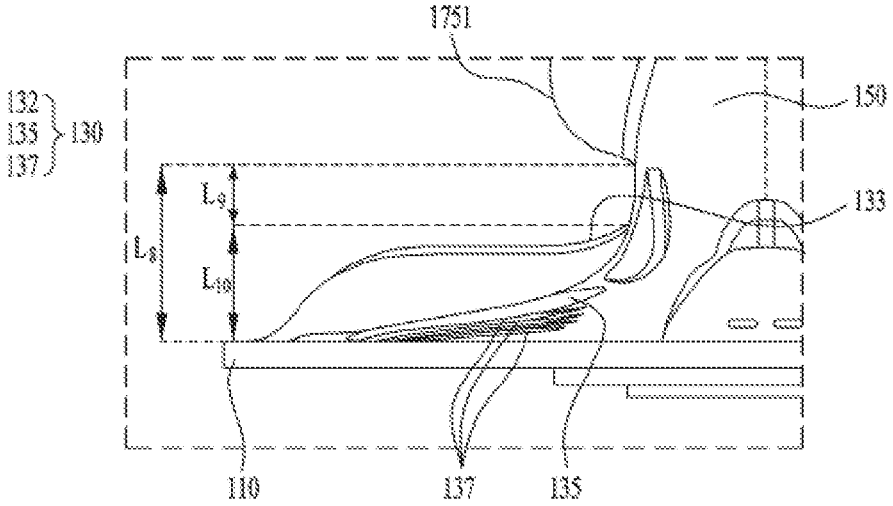
FIG. 10 is a view of a protrusion of a rotator in a laundry treating apparatus according to an embodiment of the present disclosure viewed from the side.

In one example, FIG. 10 is a view of a protrusion of a rotator in a laundry treating apparatus according to an embodiment of the present disclosure viewed from the side.

FIG. 10 shows the protrusion 130 shown in FIGS. 5 and 6 viewed in the lateral direction, that is, in the circumferential direction of the bottom portion 110.

Referring to FIGS. 5 and 6, the laundry treating apparatus 1 according to an embodiment of the present disclosure may further include the protrusion 130. The protrusion 130 may protrude from the bottom portion 110 toward the open surface 31, extend along a radial direction of the bottom portion 110, and may include a plurality of protrusions spaced apart from each other along the circumferential direction of the bottom portion 110.

The protrusion 130 protrudes from the bottom portion 110 toward the open surface 31, and extends along the radial direction of the bottom portion 110 to form the water flow in the water inside the tub 20 when the bottom portion 110 rotates. That is, in one embodiment of the present disclosure, when the rotator 100 is rotated, the blade 170 of the pillar 150 and the protrusion 130 of the bottom portion 110 may form the water flow together.

The shape of the protrusion 130 may vary. For example, a thickness of the protrusion 130 may be constant or may vary when necessary. A protruding height or an extended length of the protrusion 130 may also be variously determined.

In one embodiment of the present disclosure, as the protrusion 130 of the bottom portion 110 is disposed together with the blade 170 of the pillar 150, the blade 170 and the protrusion 130 form the water flow together, so that the water flow forming effect may be effectively improved. In addition, because the blade 170 and the protrusion 130 cooperatively form the water flow, the washing effect by the water flow may be increased and the shape of the water flow may be improved.

In one example, FIG. 6 shows the vertical level of the water surface S1 corresponding to the minimum water supply amount, and the protrusion 130 having the protruding height from the bottom portion 110 equal to or smaller than the height of the water S1 corresponding to the minimum water supply amount.

As shown in FIG. 6, in one embodiment of the present disclosure, the protrusion 130 may be constructed such that a protruding height thereof from the bottom portion 110 is equal to or smaller than a height of the water S1 corresponding to the minimum water supply amount.

As the protrusion 130 is constructed such that the protruding height thereof from the bottom portion 110, that is, a maximum vertical level of the protrusion 130 is equal to or lower than the vertical level of the water surface S1 corresponding to the minimum water supply amount, like said one end 1751*a* of the first divided blade 1751, the protrusion 130 may be constructed to always be submerged in water in the washing process to form the water flow.

Referring to FIG. 10, in one embodiment of the present disclosure, at least two of the plurality of protrusions 130 may have different protruding heights from the bottom portion 110.

In one embodiment of the present disclosure, as the plurality of protrusions 130 are constructed to have different heights, when the rotator 100 is rotated, the water flow by the protrusion 130 may be generated in a three-dimensional form, thereby effectively improving a washing performance.

In one example, referring to FIG. 10, in one embodiment of the present disclosure, the protrusion 130 may include a main protrusion 133. A plurality of main protrusions 133 may be disposed and may include an inner end facing the pillar 150. The inner end of the main protrusion 133 may be connected to the pillar 150.

The inner end of the main protrusion 133 may face the center of the bottom portion 110. That is, the inner end of the main protrusion 133 may face the pillar 150. An outer end of the main protrusion 133 may face a circumferential side of the bottom portion 110. That is, the outer end of the main protrusion 133 may face the opposite side of the inner end.

The plurality of protrusions 130 may include protrusions having different characteristics. The inner end of the main protrusion 133 among the plurality of protrusions 130 may be connected to the pillar 150. The main protrusion 133 may be integrally molded with the bottom portion 110 or may be separately manufactured and coupled thereto. The inner end of the main protrusion 133 may be integrally formed with the pillar 150 or manufactured separately and coupled and connected to the pillar 150.

FIG. 10 shows the main protrusion 133 integrally molded with the bottom portion 110 according to an embodiment of the present disclosure, and connected to the pillar 150 as the inner end thereof is integrally molded with the pillar 150.

The main protrusion 133 may greatly contribute to the formation of the water flow among the plurality of protrusions 130 when the bottom portion 110 rotates. For example, the main protrusion 133 may be constructed such that a protruding height L8 thereof from the bottom portion 110, which is the first height, is the greatest among the protruding heights of the plurality of protrusions 130, and the inner end and the pillar 150 are connected to each other, so that the main protrusion 133 may greatly contribute to the formation of the water flow.

In one example, in one embodiment of the present disclosure, the main protrusion 133 may have the protruding height L8 from the bottom portion 110 equal to or smaller than the height of the water S1 corresponding to the minimum water supply amount.

The main protrusion 133 may have the protruding height L8 of the first height, which is the greatest among the protruding heights of the plurality of protrusions 130. The main protrusion 133 may be constructed such that the protruding height L8 thereof is equal to or smaller than the height of the water S1 corresponding to the minimum water supply amount, so that the main protrusion 132 may always be submerged in the washing process.

In one example, as shown in FIG. 10, in one embodiment of the present disclosure, the protrusion 130 may further include a first sub-protrusion 130. There may be a plurality of first sub-protrusions 130, and each first sub-protrusion 130 may be disposed between a pair of main protrusions 133. A protruding height from the bottom portion 110 of the first sub-protrusion 133 may be smaller than that of the main protrusion 133.

The main protrusion 133 may extend from the pillar 150 to a circumference of the bottom portion 110, and the first sub-protrusion 130 may have a smaller extended length than the main protrusion 133. A protruding height of the first sub-protrusion 130 may be smaller than the protruding height L10 of the main protrusion 133.

The first sub-protrusion 130 may be disposed between the two main protrusions 133. The number of the main protrusions 133 and the number of first sub-protrusions 130 may be variously designed as needed. The number of the main protrusions 133 may correspond to the number of the blades 170.

In one embodiment of the present disclosure, as the number of the protrusions 130 disposed on the bottom portion 110 increases, it may be advantageous to form the water flow. However, when the plurality of protrusions 130 are made of only the main protrusions 133, the number of the main protrusions 133 may be limited by a size of the main protrusions 133. As a distance between the main protrusions 133 becomes smaller, a space between the main protrusions 133 may not affect the water flow formation and may adversely affect an increase in a washing capacity, such as forming an unnecessary vortex.

In one embodiment of the present disclosure, as the first sub-protrusion 130 rather than the main protrusion 133 is disposed between the pair of main protrusions 133, the space between the pair of main protrusions 133 may be sufficiently secured. In the space between the pair of main protrusions 133, the first sub-protrusion 130 flows the water, which is advantageous for the formation of the water flow.

The first sub-protrusion 130 may be formed in a shape of a rib extending from the pillar 150 to the circumference of the bottom portion 110. However, the shapes of the main protrusion 133 and the first sub-protrusion 130 are not necessarily limited as described above, and may be variously designed as needed.

In one example, as shown in FIG. 10, in one embodiment of the present disclosure, the protrusion 130 may further include a second sub-protrusion 130. The second sub-protrusion 130 may be disposed between the main protrusion 133 and the first sub-protrusion 130, and a protruding height from the bottom portion 110 of the second sub-protrusion 130 may be smaller than that of the first sub-protrusion 130.

The second sub-protrusion 130 may be disposed between one main protrusion 133 and one first sub-protrusion 130 positioned adjacent to said one main protrusion 133. That is, the second sub-protrusion 130 may be disposed between the main protrusion 133 and the first sub-protrusion 130.

Figure 11:
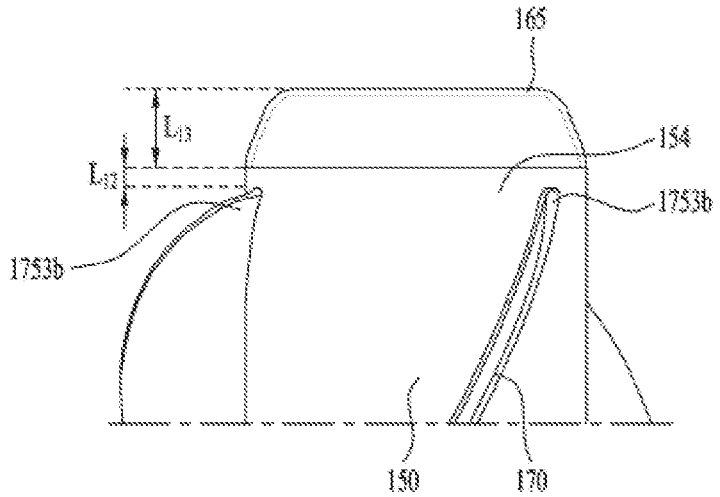
FIG. 11 is a view showing a cap coupled to a pillar in a laundry treating apparatus according to an embodiment of the present disclosure.

The second sub-protrusion 130 may be integrally formed with the bottom portion 110 or manufactured separately and coupled to the bottom portion 110. FIGS. 10 and 11 show the second sub-protrusion 130 integrally formed with the bottom portion 110 according to an embodiment of the present disclosure.

The second sub-protrusion 130 may have a smaller protruding height than the first sub-protrusion 130. For example, in one embodiment of the present disclosure, the protruding height L10 of the main protrusion 133 may correspond to the first height, the protruding height of the first sub-protrusion 130 may correspond to the second height smaller than the first height, and the protruding height of the second sub-protrusion 130 may correspond to a third height smaller than the second height.

The main protrusion 133 of the first height may be advantageous in forming a water flow of a larger scale than the first sub-protrusion 130 of the second height. The first sub-protrusion 130 of the second height may contribute to stabilizing or maintaining the water flow formed by the protrusion 130 of the first height.

That is, in one embodiment of the present disclosure, the plurality of protrusions 130 may have the main protrusion 133, the first sub-protrusion 130, and the second sub-protrusion 130 having the different heights. Accordingly, the water flow by the bottom portion 110 may be formed three-dimensionally and effectively.

In one example, FIG. 10 shows a positional relationship between the inner end of the main protrusion 133 and said one end 1751*a* of the first divided blade 1751.

In one embodiment of the present disclosure, said one end 1751*a* of the first divided blade 1751 facing toward the bottom portion 110 may be positioned to be spaced apart from the main protrusion 133 along the longitudinal direction L of the pillar 150. That is, said one end 1751*a* of the first divided blade 1751 may be spaced apart from the inner end of the main protrusion 133 based on the longitudinal direction L of the pillar 150.

In one embodiment of the present disclosure, when the pillar 150 extends in the vertical direction, it may be understood that said one end 1751*a* of the first divided blade 1751 is spaced upwardly apart from the protrusion 130.

As the main protrusion 133 and said one end 1751*a* of the first divided blade 1751 have the spaced distance L9 therebetween along the longitudinal direction L of the pillar 150, a passage region of water may be defined between the main protrusion 133 and said one end 1751*a* of the first divided blade 1751.

The passage region corresponds to a region through which the water from which the direct flow is not formed by the blade 170 and the protrusion 130 passes. Accordingly, in the rotator 100, a portion of water passes the region between the blade 170 and the protrusion 130, so that the resistance of water may be reduced.

The passage region may correspond to a connection portion of the pillar 150 and the bottom portion 110. The connection portion may need to be designed to reduce a possibility of breakage in consideration of a connection relationship between the pillar 150 and the bottom portion 110, and may correspond to a portion disadvantageous for integrally molding the first divided blade 1751 and the protrusion 130 with the pillar 150 and the bottom portion 110.

Accordingly, in one embodiment of the present disclosure, as the main protrusion 133 and one end 1751*a* of the first divided blade 1751 are spaced apart from each other along the longitudinal direction L of the pillar 150, there may be an advantage in manufacturing, and it may be advantageous in forming the water flow by effectively reducing the resistance of the water.

In one example, in one embodiment of the present disclosure, the length L10 of the inner end of the main protrusion 133 protruding from the bottom portion 110 may be greater than the upward spaced distance L9 of said one end 1751*a* of the first divided blade 1751 from the inner end of the main protrusion 133.

That is, in one embodiment of the present disclosure, based on the longitudinal direction L of the pillar 150, the spaced distance or height L9 between the inner end of the main protrusion 133 and said one end 1751*a* of the first divided blade 1751 may be smaller than the protruding length or height L10 of the main protrusion 133 from the bottom portion 110.

When the spaced distance L9 between the inner end of the main protrusion 133 and said one end 1751*a* of the first divided blade 1751 increases, it may be advantageous for reducing the resistance of water and improving the durability of the rotator 100, but it is disadvantageous for forming the water flow, so that a limit may be needed for the spaced distance L9 between the inner end of the main protrusion 133 and said one end 1751*a* of the first divided blade 1751.

In one example, in one embodiment of the present disclosure, because the protruding height L10 of the main protrusion 133 may correspond to a region in which the water flow is formed by the main protrusion 133. Thus, in one embodiment of the present disclosure, as the protruding height L10 of the main protrusion 133 is greater than the spaced distance L9 between the inner end of the main protrusion 133 and said one end 1751*a* of the first divided blade 1751, the passage region of water may be efficiently defined while securing an ability to form the water flow.

Based on the longitudinal direction L of the pillar 150, the spaced distance L9 between the inner end of the main protrusion 133 and said one end 1751*a* of the first divided blade 1751 may be variously determined as needed.

In one example, in one embodiment of the present disclosure, the height L8 of said one end 1751*a* of the first divided blade 1751 may be equal to or greater than 0.1 times the diameter W1 of the drum 30.

As described above, said one end 1751*a* of the first divided blade 1751 may be disposed at the vertical level equal to or lower than the vertical level of the water surface S1 corresponding to the minimum water supply amount. However, in order to secure the protruding height L10 of the main protrusion 133 and the spaced distance L9 between the main protrusion 133 and said one end 1751*a* of the first divided blade 1751 described above, in one embodiment of the present disclosure, the height L8 of said one end 1751*a* of the first divided blade 1751 may be equal to or greater than 0.1 times the diameter W1 of the drum 30.

That is, as described above, in one embodiment of the present disclosure, the height L8 of said one end 1751*a* of the first divided blade 1751 with respect to the bottom portion 110 may be equal to or greater than 0.1 times and equal to or less than 0.25 times the diameter W1 of the drum 30.

Accordingly, in one embodiment of the present disclosure, while sufficiently securing the protruding height L10 of the main protrusion 133 and also sufficiently securing the spaced distance L9 between the main protrusion 133 and said one end 1751*a* of the first divided blade 1751, the vertical level L8 of said one end 1751*a* of the first divided blade 1751 may be equal to or less than the vertical level of the water surface S1 corresponding to the minimum water supply amount.

The vertical level L8 of said one end 1751*a* of the first divided blade 1751 may be variously determined in a specific design by the height L10 of the main protrusion 133, the spaced distance L14 between the main protrusion 133 and the first divided blade 1751, the diameter W1 of the drum 30, the minimum water supply amount, and the like.

In one example, FIG. 11 is a view showing a cap coupled to a pillar in a laundry treating apparatus according to an embodiment of the present disclosure.

FIG. 11 shows a state in which a cap 165 is disposed at an end of the pillar 150 facing toward the open surface 31 according to an embodiment of the present disclosure.

Referring to FIG. 11, in the laundry treating apparatus 1 according to an embodiment of the present disclosure, the pillar 150 may be formed in a hollow shape, and may have an opening in communication with an interior thereof defined at the end facing toward the open surface 31. In addition, the cap 165 coupled to the end to shield the opening may be included.

The pillar 150 may be formed in the hollow shape in which an empty space is defined. Accordingly, it is advantageous that the pillar 150 may be formed through a vertical movement of the mold when molding the pillar 150, the load on the driver 50 may be reduced as a weight of the pillar 150 is reduced, and unnecessary waste of materials may be prevented.

In one example, the opening in communication with the interior of the pillar 150 in the hollow shape may be defined at the end of the pillar 150 facing toward the open surface 31. That is, when the pillar 150 extends in the vertical direction, the opening may be defined at the upper end of the pillar 150.

In order to mold the pillar 150 in the hollow shape, during the molding process of the rotator 100, a solid core-shaped mold for maintaining the shape of the pillar 150 may be inserted into the pillar 150. As such molding process is performed, the opening may be defined at the end of the pillar 150.

The pillar 150 may be formed in a cylindrical shape, and one surface facing toward the open surface 31, for example, a top surface may be opened to define the opening. However, the specific shape of the pillar 150 may be variously determined as needed.

In one example, the cap 165 may be coupled to the end of the pillar 150 to shield the opening. The cap 165 may be formed in various shapes such as a plate shape, a cup shape, or the like, and may be coupled to the end of the pillar 150 to shield the opening.

A scheme for coupling the cap 165 and the pillar 150 to each other may be varied. For example, the cap 165 may be coupled to the end of the pillar 150 in various schemes, such as a screw coupling scheme, a hook coupling scheme, or the like.

In one embodiment of the present disclosure, it is possible to secure a molding advantage and secure an advantage in manufacturing and operation of the rotator 100 as the pillar 150 is formed in the hollow shape, and it is possible to effectively prevent an unnecessary situation in which foreign substances are accumulated inside the pillar 150 as the opening 158 of the pillar 150 is shielded by the cap 165.

In one example, in an embodiment of the present disclosure, the other end 1753*b* of the second divided blade 1753 facing toward the open surface 31 may be positioned spaced apart from the cap 165. That is, the other end 1753*b* of the second divided blade 1753 may be spaced apart from the cap 165 along the longitudinal direction L of the pillar 150. When the pillar 150 extends in the vertical direction, the other end 1753*b* of the second divided blade 1753 may be spaced downward from the cap 165.

The injection molding scheme using the mold may be used in the molding process of the rotator 100, and the pillar 150, the first divided blade 1751, and the second divided blade 1753 may be integrally molded. In a molding process of the rotator 100, a cooling process of the rotator 100 may be performed, and shrinkage of the pillar 150 and the second divided blade 1753 may occur in the cooling process.

In the cooling process, depending on a thickness deviation between the second divided blade 1753 and the pillar 150 and a presence or an absence of the second divided blade 1753, a shrinkage amount may vary throughout the pillar 150. When the deformation of the pillar 150 occurs because of the variation in the shrinkage amount, it may be disadvantageous for the cap 165 to be coupled to the pillar 150.

One embodiment of the present disclosure may dispose the other end 1753*b* of the second divided blade 1753 to be spaced apart from the cap 165 so as to suppress the deviation of the shrinkage based on the presence or absence of the second divided blade 1753.

Accordingly, an amount of shrinkage deformation based on the presence or absence of the blade 170 may be reduced at the cap-coupled-portion 156 at which the cap 165 is located. Therefore, it may be easy for the cap 165 to be coupled to the pillar 150, that is, the cap-coupled-portion 156, after the rotator 100 is molded.

In one embodiment of the present disclosure, the second divided blade 1753 may be positioned such that the other end 1753*b* is spaced apart from the cap 165, and a spaced distance L12 between the other end 1753*a* and the cap 165 may be smaller than a length L13 of the cap 165 based on the longitudinal direction L of the pillar 150.

For ease of coupling of the cap 165 as described above, the other end 1753*b* of the second divided blade 1753 may be spaced apart from the cap 165. However, as the spaced distance L12 between the cap 165 and the other end 1753*b* of the second divided blade 1753 increases, a region occupied by the second divided blade 1753 in the pillar 150 may be reduced, and it may be disadvantageous in improving a contact area between the second divided blade 1753 and the water.

Accordingly, one embodiment of the present disclosure may limit the spaced distance L12 between the cap 165 and the second divided blade 1753 to be smaller than the length L13 of the cap 165. The spaced distance L13 between the cap 165 and the second divided blade 1753 and the length L13 of the cap 165 may be understood as vertical distances along the longitudinal direction L of the pillar 150 as shown in FIG. 11.

The spaced distance L12 between the cap 165 and the second divided blade 1753 and the length L13 of the cap 165 may be specifically determined in consideration of various factors such as the length L1 of the pillar 150, utilization of the cap 165, the thickness or the inclination angle θ2 of the second divided blade 1753, and the like.

Figure 12:
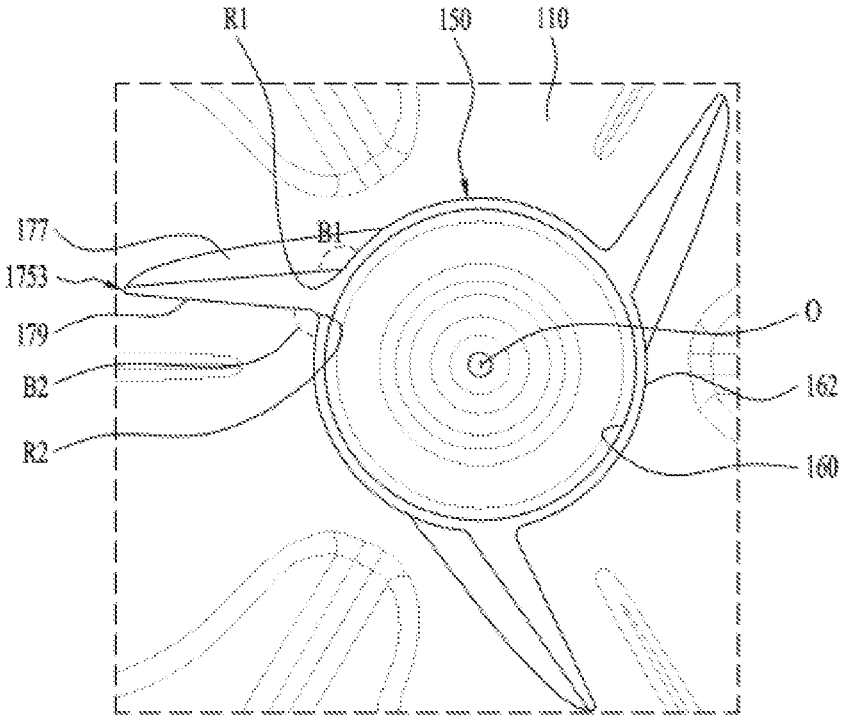
FIG. 12 is a top view of a rotator in a laundry treating apparatus according to an embodiment of the present disclosure.

In one example, FIG. 12 is a top view of a rotator in a laundry treating apparatus according to an embodiment of the present disclosure.

In one embodiment of the present disclosure, the first divided blade 1751 and the second divided blade 1753 may include one surface 177 at least a portion of which faces toward the open surface 31, and the other surface 179 located on an opposite side of the one surface 177, and at least partially facing toward the bottom portion 110.

Although only the second divided blade 1753 is shown in FIG. 12, the same description may be applied to the first divided blade 1751. In FIG. 12, the first divided blade is omitted, and the second divided blade 1753 will be described.

In one embodiment of the present disclosure, when viewed from the open surface 31, said one surface 177 may be connected to form an obtuse angle with respect to the outer circumferential surface 162 of the pillar 150 and the other surface 179 may be connected to form an acute angle.

Specifically, the second divided blade 1753 may protrude from the outer circumferential surface 162 of the pillar 150 outwardly of the pillar 150, and may have said one surface 177 and the other surface 179. In one embodiment of the present disclosure, said one surface 177 of the first divided blade 1751 and the second divided blade 1753 may be understood as a surface at least a portion of which faces toward the open surface 31, and the other surface 179 of the second divided blade 1753 may be understood as a surface at least a portion of which faces toward the bottom portion 110.

That is, as shown in FIG. 4, when the second divided blade 1753 extends obliquely in said one direction C1 among the circumferential directions C of the pillar 150, said one surface 177 of the blade 170 may correspond to a surface directed in the other direction C2 among the circumferential directions C of the pillar 150, and the other surface 179 of the blade 170 may correspond to a surface directed in said one direction C1 among the circumferential directions C of the pillar 150.

Said one surface 177 of the second divided blade 1753 may correspond to a surface that ascends water upward when the pillar 150 rotates in the other direction C2, and the other surface 179 of the second divided blade 1753 may correspond to a surface that descends water to downward when the pillar 150 rotates in said one direction C1.

In addition, referring to FIG. 12, when viewed from the open surface 31 or when viewed from above when the pillar 150 extends in the vertical direction, said one surface 177 of the second divided blade 1753 may be connected such that an angle B1 thereof with respect to the outer circumferential surface 162 of the pillar 150 forms an obtuse angle.

Accordingly, when the pillar 150 is rotated, said one surface 177 of the second divided blade 1753 may move such that the resistance by water may be effectively reduced, and the water and the laundry may spread outward in a radial direction of the bottom portion 110, thereby preventing tangling of the laundry.

For example, when said one surface 177 of the second divided blade 1753 forms an acute angle with respect to the outer circumferential surface 162 of the pillar 150, the laundry may show a tendency to gather to the center O of the pillar 150 when the rotator 100 is rotated to form the ascending water flow. When the pillar 150 is extended in the vertical direction, it may be difficult for the laundry, which gathers to the center O of the pillar 150, to spread to the inner circumferential surface of the drum 30 again by the self load of the laundry.

Therefore, in one embodiment of the present disclosure, when the pillar 150 rotates in the other direction C2, said one surface 177 of the second divided blade 1753 that forms the ascending water flow forms an obtuse angle with respect to the outer circumferential surface 162 of the pillar 150, so that, together with the formation of the ascending water flow, the laundry may be moved to be away from the pillar 150, thereby suppressing the tangling of the laundry.

In one example, when viewed from the open surface 31, the other surface 179 of the second divided blade 1753 may be connected while an angle B2 thereof with respect to the outer circumferential surface 162 of the pillar 150 forms an acute angle.

The other surface 179 of the second divided blade 1753 may be constructed to form the acute angle with respect to the outer circumferential surface 162 of the pillar 150 in a geometric relationship with said one surface 177 of the second divided blade 1753 that forms the obtuse angle with respect to the outer circumferential surface 162 of the pillar 150.

In addition, in one embodiment of the present disclosure, as the other surface 179 of the second divided blade 1753 forms the acute angle, when the rotator 100 is rotated in said one direction C1 to form the descending water flow by the other surface 179 of the second divided blade 1753, a water flow in which the laundry gathers toward the pillar 150 is formed, so that a motion in which laundry existing at a lower portion of the drum 30 is pushed by laundry at an upper portion to be away from the pillar 150 may be induced.

Such movement tendency of the laundry in the descending water flow may be related to the self load of the laundry. That is, when the descending water flow is formed by the rotation of the second divided blade 1753, as the laundry is moved toward the pillar 150 and descends, the laundry existing at the lower portion of the drum 30 may move toward the inner circumferential surface of the drum 30 by a load of the laundry descending from the upper portion.

In one example, referring to FIG. 12, in one embodiment of the present disclosure, said one surface 177 of the second divided blade 1753 may be connected while forming a curvature with respect to the outer circumferential surface 162 of the pillar 150. In addition, the other surface 179 of the second divided blade 1753 may also be connected while forming a curvature with respect to the outer circumferential surface 162 of the pillar 150.

In one embodiment of the present disclosure, as said one surface 177 and the other surface 179 of the second divided blade 1753 are connected to the outer circumferential surface 162 of the pillar 150 while respectively forming the curvatures, fluidity of water flowing along said one surface 177 and the other surface 179 of the second divided blade 1753 may be improved and the resistance by the water may be reduced when the pillar 150 is rotated.

In addition, as shown in FIG. 12, in one embodiment of the present disclosure, a curvature R1 of said one surface 177 of the second divided blade 1753 with respect to the outer circumferential surface 162 of the pillar 150 may be smaller than a curvature R2 of the other surface 179 of the second divided blade 1753.

That is, the curvature R2 formed by the other surface 179 of the second divided blade 1753 with respect to the outer circumferential surface 162 of the pillar 150 may be greater than the curvature R1 formed by said one surface 177 of the second divided blade 1753. Accordingly, water resistance and fluidity with respect to the other surface 179 of the second divided blade 1753 that forms the acute angle with respect to the outer circumferential surface 162 of the pillar 150 may be effectively improved.

Although said one surface 177 and the other surface 179 of the second divided blade 1753 have been described, such technology may be equally applied to said one surface 177 and the other surface 179 of the first divided blade 1751.

Figure 13:
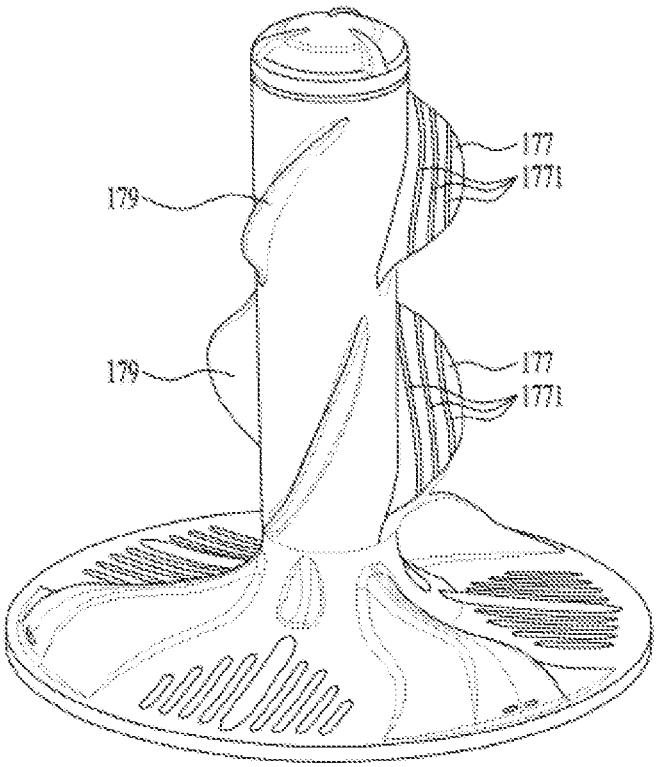
FIG. 13 is a view showing a protrusion of a rotator in a laundry treating apparatus according to an embodiment of the present disclosure.

In one example, FIG. 13 is a view showing a protrusion of a rotator in a laundry treating apparatus according to an embodiment of the present disclosure.

As described above, in one embodiment of the present disclosure, the first divided blade 1751 and the second divided blade 1753 may include said one surface 177 at least the portion of which faces toward the open surface 31, and the other surface 179 located on the opposite side of the one surface 177, and at least partially facing toward the bottom portion 110.

The laundry treating apparatus 1 according to one embodiment of the present disclosure may include a protrusion 1771 protruding from at least one of said one surface 177 and the other surface 179 and extending parallel to an extension direction of the first divided blade 1751 and the second divided blade 1753.

FIG. 13 shows the protrusion 1771 protruding from said one surface. The protrusion 1771 may protrude from said one surface 177 in a direction opposite to the other surface 179 along the extension direction of the first divided blade 1751 and the second divided blade 1753.

As the protrusion 1771 is formed, when the laundry or the wash water and the first divided blade 1751 and the second divided blade 1753 come into contact with each other, a frictional force may be increased.

In addition, when the ascending water flow or the descending water flow is generated by forming the protrusion 1771, a vortex may be formed in the water flow passing through the first divided blade 1751 and the second divided blade 1753. Accordingly, the washing efficiency may be increased, and the foreign substances on the laundry may be effectively removed.

Figure 14:
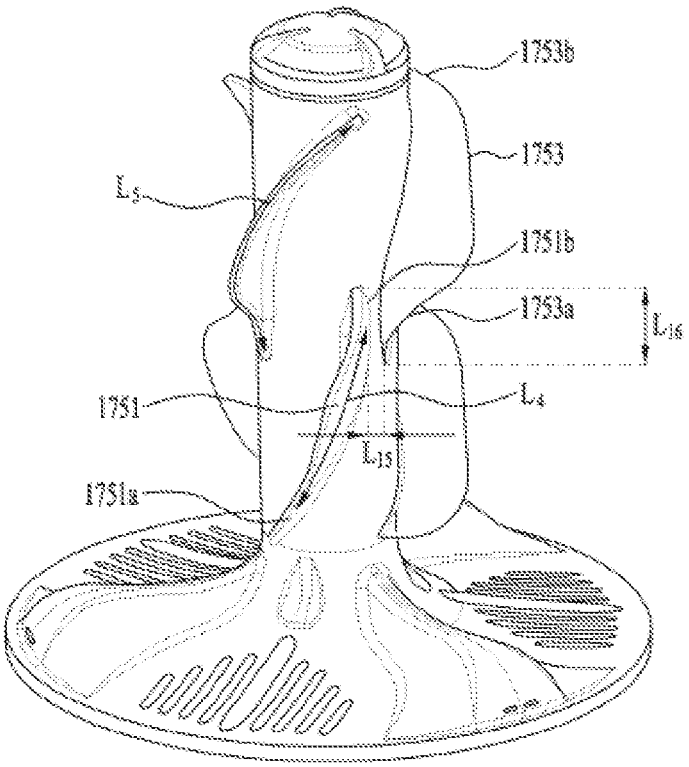
FIG. 14 is a view showing another embodiment of a rotator in a laundry treating apparatus according to an embodiment of the present disclosure.

In one example, FIG. 14 is a view showing another embodiment of a rotator in a laundry treating apparatus according to an embodiment of the present disclosure.

The other end 1751*b* of the first divided blade 1751 may be disposed to overlap the second divided blade 1753 based on the circumferential direction of the pillar.

That is, the height from the bottom portion 110 to the other end 1751*b* of the first divided blade 1751 may be larger than the height from the bottom portion 110 to said one end 1753*a* of the second divided blade 1753.

Accordingly, the extension length L4 of the first divided blade 1751 and the extension length L5 of the second divided blade 1753 may be larger than those of the rotator 100 according to one embodiment of the present disclosure in FIG. 5 based on the same height of the pillar 150.

As the extension lengths L4 and L5 are large, the ascending water flow or the descending water flow may be formed strongly, and the wash water may be prevented from escaping into the space where the first divided blade 1751 and the second divided blade 1753 are spaced apart from each other.

In one example, as shown in FIG. 14, a spaced distance between the other end 1751*b* of the first divided blade 1751 and said one end 1753*a* of the second divided blade 1753 may be defined as a length L15 from the other end 1751*b* of the first divided blade 1751 to said one end 1753*a* of the second divided blade 1753 based on the circumferential direction C of the pillar 150, and a length L16 from the other end 1751*b* of the first divided blade 1751 to said one end 1753*a* of the second divided blade 1753 based on the longitudinal direction L of the pillar 150.

The spaced distances L15 and L16 between the other end 1751*b* of the first divided blade 1751 and said one end 1753*a* of the second divided blade 1753 may be sufficient large to prevent the laundry from being tangled in the space between the first divided blade 1751 and the second divided blade 1753.

However, when the spaced distances L15 and L16 are too large, the laundry and the water flow may excessively pass through the space defined between the first divided blade 1751 and the second divided blade 1753, so that the ascending water flow or the descending water flow may not be formed, which may directly result in reduced washing performance.

Accordingly, the spaced length L15 based on the circumferential direction C of the pillar 150 and the spaced length L16 based on the longitudinal direction L of the pillar 150 may be variously determined in consideration of the sizes of the tub 20 and the drum 30 of the laundry treating apparatus 1, the diameter of the pillar 150, the number of turns the blade 170 is wound around the pillar 150, an allowable capacity of the laundry, and a water supply amount resulted therefrom.

Although various embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of rights of the present disclosure should not be limited to the described embodiment and should be defined by the claims described later as well as the claims and equivalents.

What is claimed is:

1. A laundry treating apparatus comprising:

a tub configured to receive water;

a drum rotatably disposed inside the tub, the drum having an open surface configured to receive laundry therethrough and a bottom surface located at an opposite side of the open surface; and a rotator rotatably disposed inside the drum, the rotator comprising:

a bottom portion positioned at the bottom surface of the drum, a pillar that protrudes from the bottom portion toward the open surface of the drum, and a blade disposed at an outer circumferential surface of the pillar, the blade having a first end facing the bottom portion and a second end facing the open surface of the drum, wherein the blade comprises a plurality of blade divisions that are spaced apart from one another by a predetermined distance in a circumferential direction of the pillar and arranged from the first end of the blade to the second end of the blade, wherein each of the plurality of blade divisions extends obliquely with respect to the bottom portion, and wherein the plurality of blade divisions are arranged along a continuous curve on the outer circumferential surface of the pillar, the continuous curve extending from the first end of the blade to the second end of the blade along a direction obliquely extending with respect to the bottom portion and a longitudinal direction of the pillar.

2. The laundry treating apparatus of claim 1, wherein the plurality of blade divisions are arranged obliquely with respect to the bottom portion such that the blade is configured to generate an ascending water flow or a descending water flow in the drum based on rotation of the rotator.

3. The laundry treating apparatus of claim 1, wherein the blade is one of a plurality of blades that are disposed on the outer circumferential surface of the pillar and spaced apart from one another in in the circumferential direction of the pillar, and wherein a distance between adjacent two blades among the plurality of blades in the circumferential direction of the pillar is constant along the longitudinal direction of the pillar.

4. The laundry treating apparatus of claim 2, wherein the blade has:

a first surface that at least partially faces the open surface of the drum; and a second surface that at least partially faces the bottom portion and is disposed at an opposite side of the first surface of the blade, and wherein the rotator further comprises a blade protrusion that protrudes from at least one of the first surface of the blade or the second surface of the blade, the blade protrusion extending along the blade.

5. The laundry treating apparatus of claim 2, wherein the plurality of blade divisions comprise:

a first blade division having a first end corresponding to the first end of the blade and a second end facing the open surface of the drum; and a second blade division having a first end facing the bottom portion and a second end corresponding to the second end of the blade.

6. The laundry treating apparatus of claim 5, wherein the second end of the first blade division faces the first end of the second blade division.

7. The laundry treating apparatus of claim 5, wherein the second end of the first blade division is disposed above the first end of the second blade division such that the first blade division overlaps with the second blade division along the circumferential direction of the pillar.

8. The laundry treating apparatus of claim 6, wherein an inclination angle of the first blade division with respect to the bottom portion increases as the first blade division extends toward to the second blade division.

9. The laundry treating apparatus of claim 8, wherein an inclination angle of the second blade division with respect to the bottom portion decreases as the second blade division extends away from the first blade division.

10. The laundry treating apparatus of claim 9, wherein the inclination angle of the first blade division at the first end of the first blade division is equal to the inclination angle of the second blade division at the second end of the second blade division.

11. The laundry treating apparatus of claim 5, wherein an extension length of the first blade division along the outer circumferential surface of the pillar is equal to an extension length of the second blade division along the outer circumferential surface of the pillar.

12. The laundry treating apparatus of claim 5, wherein the pillar defines a hollow space therein and an opening that faces the open surface of the drum, and wherein the rotator further comprises a cap that is coupled to the pillar and that covers the opening of the pillar.

13. The laundry treating apparatus of claim 12, wherein the first blade division is spaced apart from the bottom portion, and the second blade division is spaced apart from the cap.

14. The laundry treating apparatus of claim 6, wherein a protruding length of the first blade division from the pillar decreases as the first blade division extends toward the second end of the first blade division facing the second blade division, and wherein a protruding length of the second blade division from the pillar decreases as the second blade division extends toward the first end of the second blade division facing the first blade division.

15. The laundry treating apparatus of claim 14, wherein a reduction rate of the protruding length of the first blade division decreases as the first blade division extends toward to the second blade division, and wherein a reduction rate of the protruding length of the second blade division decreases as the second blade division extends toward the first blade division.

16. The laundry treating apparatus of claim 14, wherein the protruding length of the first blade division decreases as the first blade division extends toward the first end of the first blade division facing the bottom portion, and wherein the protruding length of the second blade division decreases as the second blade division extends toward the second end of the second blade division facing the open surface of the drum.

17. The laundry treating apparatus of claim 9, wherein the first blade division has a first curved shape protruding toward a first circumferential direction, and wherein the second blade division has a second curved shape protruding toward a second circumferential direction opposite to the first circumferential direction.

18. The laundry treating apparatus of claim 5, wherein the first blade division and the second blade division face each other along a longitudinal direction of the pillar.

19. The laundry treating apparatus of claim 1, wherein the rotator further comprises a main protrusion that protrudes from the bottom portion, the main protrusion having an inner end coupled to the pillar and spaced apart from the first end of the blade.

20. The laundry treating apparatus of claim 19, wherein a vertical distance between the first end of the blade and the inner end of the main protrusion is less than a vertical distance between the bottom portion and the inner end of the main protrusion.

* * * * *